US008342584B1

(12) United States Patent
Carmichael

(10) Patent No.: US 8,342,584 B1
(45) Date of Patent: Jan. 1, 2013

(54) METHOD OF MANUFACTURING A LIFTING SLING

(76) Inventor: Daniel T. Carmichael, Chattanooga, TN (US)

( * ) Notice: Subject to any disclaimer, the term of this patent is extended or adjusted under 35 U.S.C. 154(b) by 204 days.

(21) Appl. No.: 12/651,163

(22) Filed: Dec. 31, 2009

Related U.S. Application Data

(60) Division of application No. 10/862,867, filed on Jun. 7, 2004, now Pat. No. 7,658,423, which is a continuation-in-part of application No. 10/722,187, filed on Nov. 25, 2003, now Pat. No. 7,669,904.

(51) Int. Cl.
*B66C 1/12* (2006.01)
*D02G 3/36* (2006.01)

(52) U.S. Cl. ..... 294/74; 57/217

(58) Field of Classification Search ..... 294/74, 294/75; 112/417, 420; 57/3, 21, 201, 210, 57/213, 214, 217, 218, 230, 232, 234
See application file for complete search history.

(56) References Cited

U.S. PATENT DOCUMENTS

| | | | | |
|---|---|---|---|---|
| 3,992,048 | A | 11/1976 | Berzenye | |
| 4,052,095 | A | 10/1977 | Johnson | |
| 4,098,861 | A | 7/1978 | Bassani | |
| 4,232,619 | A | 11/1980 | Lindahl | |
| 4,350,380 | A | 9/1982 | Williams | |
| 4,789,045 | A | 12/1988 | Pugh | |
| 4,843,807 | A | 7/1989 | von Danwitz | |
| 4,850,629 | A | 7/1989 | St. Germain | |
| 4,856,836 | A | 8/1989 | Delphin | |
| 5,219,636 | A | 6/1993 | Golz | |
| 5,419,951 | A | 5/1995 | Golz | |
| 5,460,883 | A | 10/1995 | Barber et al. | |
| 5,498,047 | A | 3/1996 | Treuling | |
| 5,651,572 | A | 7/1997 | St. Germain | |
| 5,688,011 | A | 11/1997 | Gulley | |
| 5,853,005 | A | 12/1998 | Scanlon | |
| 6,059,335 | A | 5/2000 | Matson | |
| 6,149,215 | A | 11/2000 | Balogh et al. | |
| 6,375,241 | B1 | 4/2002 | Sadeck | |
| 6,397,574 | B1 | 6/2002 | De Angelis | |
| 6,422,624 | B1 | 7/2002 | Kauffman et al. | |
| 6,443,660 | B1 | 9/2002 | Smith et al. | |
| 6,543,826 | B1 | 4/2003 | Aston | |
| 6,601,890 | B1 | 8/2003 | Firth | |
| 7,658,423 | B1 * | 2/2010 | Carmichael | 294/74 |
| 7,669,904 | B1 * | 3/2010 | Carmichael | 294/74 |
| 2008/0061572 | A1 | 3/2008 | Harada et al. | |

OTHER PUBLICATIONS

Marc Broekaert, "Ployurea Spray Coatings", 2002.

* cited by examiner

*Primary Examiner* — Paul T Chin
(74) *Attorney, Agent, or Firm* — H. Brock Kolls

(57) ABSTRACT

The present invention relates to a method of manufacturing single and multi-core lifting slings, the method comprising: aligning a plurality of core fibers to form a sling body; applying a coating along length of the sling body, wherein an initial layer of the coating seals the plurality of core fibers from exposure to contaminates; and applying additional layers of the coating in areas of the sling body subject to high crush and shear forces. Other exemplary embodiments include tensioning the plurality of core fibers and forming a multi-core lifting sling by applying a seaming coat of the coating material to the sling body and at least to one of a second sling body. In an exemplary embodiment, the coating can be at least an isocyanate mixed with an amine forming polyurea.

12 Claims, 27 Drawing Sheets

126

126

126

126

500

500

500

1000

2000

3000

4000

5000

6000

7000

8000

METHOD OF MANUFACTURING A LIFTING SLING

RELATED APPLICATIONS

This application contains subject matter which is related to the subject matter of the following applications. Each of the below listed applications is hereby incorporated herein by reference in its entirety:

This application is a division of U.S. non-provisional application Ser. No. 10/862,867, inventor Daniel T. Carmichael, entitled "LIFTING SLING ADAPTED TO EFFECTUATE CARGO SECURITY", filed Jun. 7, 2004 now U.S. Pat. No. 7,658,423; which is a continuation in part of U.S. non-provisional application Ser. No. 10/722,187, inventor Daniel T. Carmichael, entitled "IMPROVED LIFTING SLING HAVING A TENACIOUS COATING WITH METHODS OF MANUFACTURING AND MONITORING THE SAME", filed Nov. 25, 2003 now U.S. Pat. No. 7,669,904.

TECHNICAL FIELD OF THE INVENTION

The present invention relates to a method of manufacturing single and multi-core lifting slings, and particularly to a method comprising: aligning a plurality of core fibers to form a sling body; applying a coating along length of the sling body, wherein an initial layer of the coating seals the plurality of core fibers from exposure to contaminates; and applying additional layers of the coating in areas of the sling body subject to high crush and shear forces. Other exemplary embodiments include tensioning the plurality of core fibers and forming a multi-core lifting sling by applying a seaming coat of the coating material to the sling body and at least to one of a second sling body. In an exemplary embodiment, the coating can be at least an isocyanate mixed with an amine forming polyurea.

BACKGROUND OF THE INVENTION

Lifting slings are commonly used to lift heavy loads, secure cargo, and for numerous other lifting and securing activities. During normal operation the lifting sling can be subjected to forces that can result in damage to the lifting sling materials. Such forces can include crushing, pinching, binding, and stretching to name a few. Damage to the lifting sling materials can cause catastrophic failure during use and as such is a critical concern to those who manufacture, sell, and use lifting slings.

A regular inspection of the lifting sling is typically required as an attempt to avoid catastrophic failure of the lifting sling under load. However, inspection of the lifting sling can be difficult in that much of the lifting sling may be covered or inaccessible. In addition, it can be very difficult to visually identify lifting sling over-stretching and other types of forces, traumas, or crushing types of lifting sling damage.

In addition to the inability to accurately determine by visual inspection lifting sling damage and in particular lifting sling damage to the core materials, damage by ultraviolet light can also render a lifting sling unsuitable for use. In this regard, and for example, nylon and polyester lifting sling materials can be damaged by excessive or prolonged exposure to ultraviolet light. As such, while visually appearing as though the lifting sling is suitable for use, the lifting sling can be prematurely rendered unsuitable for use by ultraviolet light that has damaged the nylon and polyester materials. It is only during loading conditions that a lifting sling having ultraviolet light damage may rupture causing a catastrophic failure.

In addition to lifting slings being damaged by excessive forces, crushing, pinching, binding, stretching, and ultraviolet light exposure, dirt and other contaminants can also cause damage to the lifting sling core materials. In this regard, dirt and contaminants can increase the abrasion among the lifting slings core materials and or core fibers. As such, the increased abrasion among the core materials can cause premature degradation of the lifting sling, and or result in a catastrophic failure of the lifting sling during use. Dirt and contaminants introduced into the core materials, causing an increase in abrasion of the core materials, are particularly damaging to nylon types and polyester types of lifting slings.

Currently users of lifting slings are encouraged to clean the lifting slings periodically to minimize the presence of dirt and contaminants within the lifting sling core materials. Though a good recommendation, in practice lifting slings find applications in factories, on truck beds, on loading docks, and other places where dirt and contaminants are plentiful and the washing of lifting slings on a regular basis is impractical.

In general, contaminants such as dirt, chemicals, ultraviolet light, and other elements that come in contact with the lifting sling can prematurely degrade the lifting sling and or cause catastrophic lifting sling failure. In addition, excessive heat exposure can cause the lifting sling to warp, melt, pit, or otherwise become damaged. As such, exposure to excessive heat can result in premature and permanent degradation of the lifting sling materials and lead to an increased possibility of catastrophic lifting sling failure under load.

Overstretching a lifting sling can also permanently damage the lifting sling and rendered it unsuitable for use. In this regard, applying a load to a lifting sling beyond the lifting slings rated safe limits can cause the lifting sling to stretch. Stresses resulting in overstretching of a lifting sling are particularly common and can permanently damage nylon and polyester types of lifting sling materials. Once over stretched the lifting sling cannot be repaired. In addition, once over stretched the lifting sling can no longer carry the maximum load for which the lifting sling is rated.

In an attempt to protect the lifting sling core materials and to extend the operational or service life of the lifting sling it is common to employ the use of a lifting sling cover or sheath. The cover or sheath is typically placed around the lifting sling core materials to provide an interface between the lifted or secured load and the lifting sling core materials. In this regard, the cover provides protection to the lifting sling core against abrasions, cuts, crushing, binding, and other similar load related forces and injuries.

Lifting sling covers or sheaths can however prevent a thorough inspection of the lifting sling since the cover or sheath is typically wrapped around the lifting sling core materials keeping at least a portion of the lifting sling core materials hidden from sight. The problem of lifting sling safety and the use of covers and sheaths is further complicated in that, with a cover or sheath wrapped around the lifting sling core materials, cleaning dirt and contaminants from the lifting sling core materials is more difficult.

In addition to keeping dirt, chemicals, and other contaminants trapped and concealed within the lifting sling core materials, the lifting sling cover or sheath can require an extensive manufacturing process to fabricate. In this regard, covers or sheaths can require extensive stitching or other fabricating steps to secure the shape and fit of the cover or sheath around the lifting sling core materials.

Furthermore, lifting sling covers and sheaths are designed to cover the lifting sling core materials in a loose fitting fashion. This loose fitting fashion tends to cause the covers or sheaths to slide back and forth over the lifting sling core materials. The ability of the covers or sheaths to slide back-and-forth over the lifting sling core materials can result in the lifting sling's inability to grip the load and otherwise promote slippage of the load. Shifting loads can be an extreme danger and as such a lifting sling that has an inability to reliably grip the load and otherwise minimize slippage of the load is of little value and is a safety risk.

Concerns of safety, damage, and catastrophic failure of the lifting sling has given rise to numerous safety recommendations in the industry. Such safety recommendations include employing regular inspections of the lifting slings, as well as promoting other safeguards such as cleaning the lifting slings regularly. Safety, damage, and catastrophic failure of lifting slings has also given rise to attempts to protect the lifting sling from excessive abrasion, and other crushing, or pinching forces, as well as other types of traumas by utilizing covers or sheaths.

Attempts in the lifting sling industry to better manage the operational capabilities and suitability for use of the lifting sling has seen the use of optical inspection methods aimed at determining the suitability for use of the lifting sling. Such methods have seen the use of fiber optic cables that require a flashlight or light source and a skilled individual to evaluate test results as one way of determining the suitability for use of a lifting sling.

In this regard, a skilled individual performing a test can direct a flashlight beam or other light source into one end of a fiber optic cable and visually determined if the light source is present at the other end of the fiber-optic cable. Subjective and clumsy, this test then assumes that if forces applied to the lifting sling have not damaged the fiber optic cable, then the lifting sling is suitable for use.

In actuality there is little correlation between damage to a fiber-optic cable located in proximity to lifting sling core materials and damage to the lifting sling core materials themselves. Furthermore, fiber optic cable tests do not take into consideration dirt, chemicals, heat, ultraviolet light, and other destructive conditions as well as excessive loading and stretching of the lifting sling core materials, all of which can degrade the lifting sling and or cause catastrophic failure under load of the lifting sling.

In addition, the use of a cover or sheath can reduce the effectiveness of fiber optic cable inspection methods and the use of a cover or sheath may prevent the fiber optic cable from being subjected to the same forces as the lifting sling core materials.

There is a long felt need for a lifting sling that can overcome the limitations of the current lifting slings available on the market today. Such limitations can include the damaging effects heat and or ultraviolet light can have on lifting sling materials, in particular on nylon and polyester types of lifting slings.

Other limitations include the detrimental effects dirt, chemicals, heat, and other contaminants can have on the lifting sling core materials. In general, dirt, chemicals, and other contaminants can increase the abrasion amongst the lifting sling core fiber materials, which can result in permanent damage of the lifting sling.

Additionally there is a long felt need for a lifting sling having an indicator or electronic system attached thereto for aiding in determining when damage to the lifting sling core materials has occurred.

There is also a long felt need in the lifting sling industry for a better way to manufacture multi-core lifting slings. In this regard, quite often a multi-core lifting sling is fabricated with a series of single core members held into position by a stitched or sewn cover or sheath. As such, inspection of the multi-core lifting sling elements is difficult at best and the current preferred structure, of sewn covers or sheaths, precipitates the collection of dirt, chemicals, and contaminants which can prematurely degrade the lifting sling, hide damage, and or lead to potentially catastrophic lifting sling failure under load.

There is a need for a multi-core lifting sling that, while sealing dirt, chemicals and contaminants away from the lifting sling core materials, also binds a plurality of single core members into a superior multi-core lifting sling structure.

In addition, there is currently no way to monitor and track the use of lifting slings, including the monitoring and tracking of the types of loads that have been lifted, the frequency of use, and other telemetry and data that can be utilized to determine if the lifting sling is suitable for use and or if the lifting sling has been subjected to forces or contaminants that have damaged the lifting sling materials.

There is a long felt need for a lifting sling that can overcome these and other limitations, which in part gives rise to the following invention.

SUMMARY OF THE INVENTION

The shortcomings of the prior art are overcome and additional advantages are provided through the provision of a method of manufacturing single and multi-core lifting slings, the method comprising: aligning a plurality of core fibers to form a sling body; applying a coating along length of the sling body, wherein an initial layer of the coating seals the plurality of core fibers from exposure to contaminates; and applying additional layers of the coating in areas of the sling body subject to high crush and shear forces.

Additional shortcomings of the prior art are overcome and additional advantages are provided through the provision of a method of manufacturing single and multi-core lifting slings, the method comprising: aligning a plurality of core fibers to form a sling body; tensioning the plurality of core fibers; and applying a coating along length of the sling body, wherein an initial layer of the coating seals the plurality of core fibers from exposure to contaminates.

Additional shortcomings of the prior art are overcome and additional advantages are provided through the provision of a method of manufacturing single and multi-core lifting slings, the method comprising: forming a sling body and at least one of a second sling body from a plurality of core fibers; applying a coating along length of the sling body and the second sling body, wherein an initial layer of the coating seals the plurality of core fibers from exposure to contaminates; and forming a multi-core lifting sling by applying a seaming coat of the coating material to the sling body and at least to one of the second sling body.

Other aspects of the present invention include systems and computer readable media for carrying out the methods and processes described above.

BRIEF DESCRIPTION OF THE FIGURES

The present invention is best understood from the following detailed description when read in connection with the accompanying drawings. Included in the drawings are the following Figures.

DETAILED DESCRIPTION OF THE INVENTION

The preferred embodiments of the present invention will now be described in detail with reference to the Figures. Although the lifting slings, systems, and methods of the present invention will be described in connection with these preferred embodiments and drawings, it is not intended to be limited to the specific form set forth herein, but on the contrary, it is intended to cover such alternatives, modifications, and equivalents, as can be reasonably included within the spirit and scope of the invention.

Figure 1A:
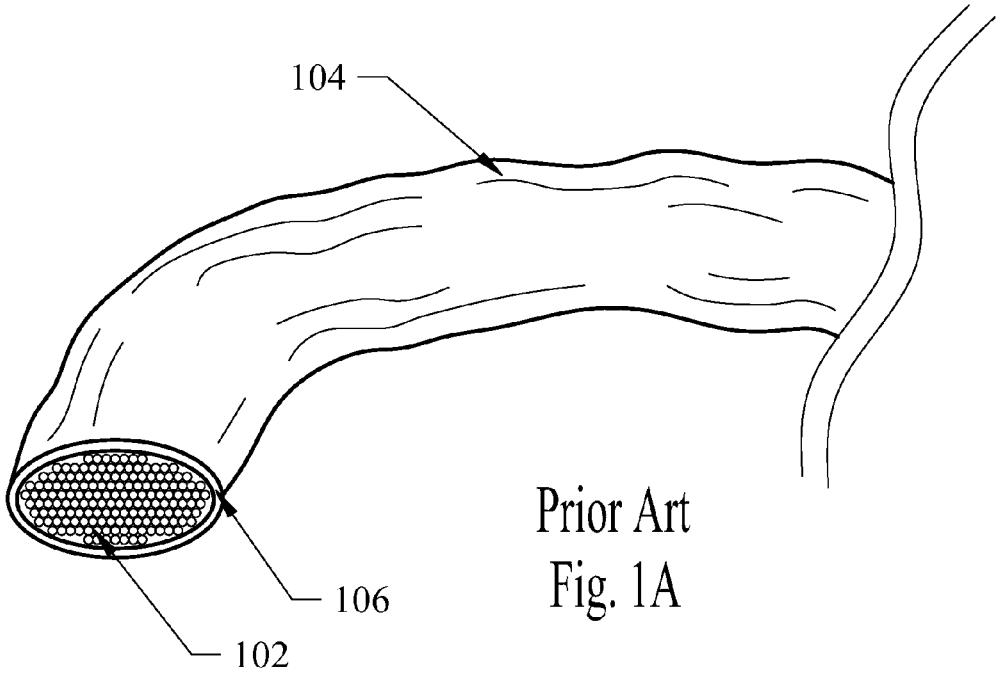
Prior Art Fig. 1A
FIG. 1A there is shown a cross sectional view of a lifting sling core having a protective sheath (PRIOR ART)

Referring to FIG. 1A there is shown a cross sectional view of a lifting sling core having a protective sheath. FIG. 1A depicts an example of a prior art style or type of lifting sling. In this regard, the lifting sling core 102 is surrounded by a protective sheath 106. The lifting sling combination of the core 102 and sheath 106 can be referred to as prior art lifting sling 104. In an attempt to protect the core 102 from operational and force related traumas or damage certain prior art lifting slings 104 place a sheath around the lifting sling core 102.

The lifting sling core 102 and sheath 106 are two separate elements. As such, as pressure and or forces on the prior art lifting sling 104 change, primarily resultant from the loads being lifted, the lifting sling core 102 can slide on the inside surface of sheath 106. This can result in an increase of friction, heat, core fiber fraying, and abrasion that can damage the lifting sling core 102. Furthermore, core 102 frictional forces and slippage can result in damage to sheath material 106.

In addition, the lifting sling core 102 under load can change in size resultant from the core 102 fibers being pulled closer together as loads on the prior art lifting sling 104 increase, and moving further apart as loads on the prior art lifting sling 104 decrease. Since the sheath 106 is a separate element from the lifting sling core 102, the decrease in diameter of the lifting core 102 coupled with the frictional forces between the load being lifted and the sheath 106 can result in the lifting sling core 102 moving or sliding inside the sheath 106. This sliding can cause lifted or secured loads to shift and can facilitate rapid degradation and destruction to both the lifting sling core 102 and sheath 106.

The destructive force between the core 102 and sheath 106 can increase the chances of catastrophic failure of the prior art lifting sling 104 as well as increase the difficulty in preventing load shifting.

Figure 1B:
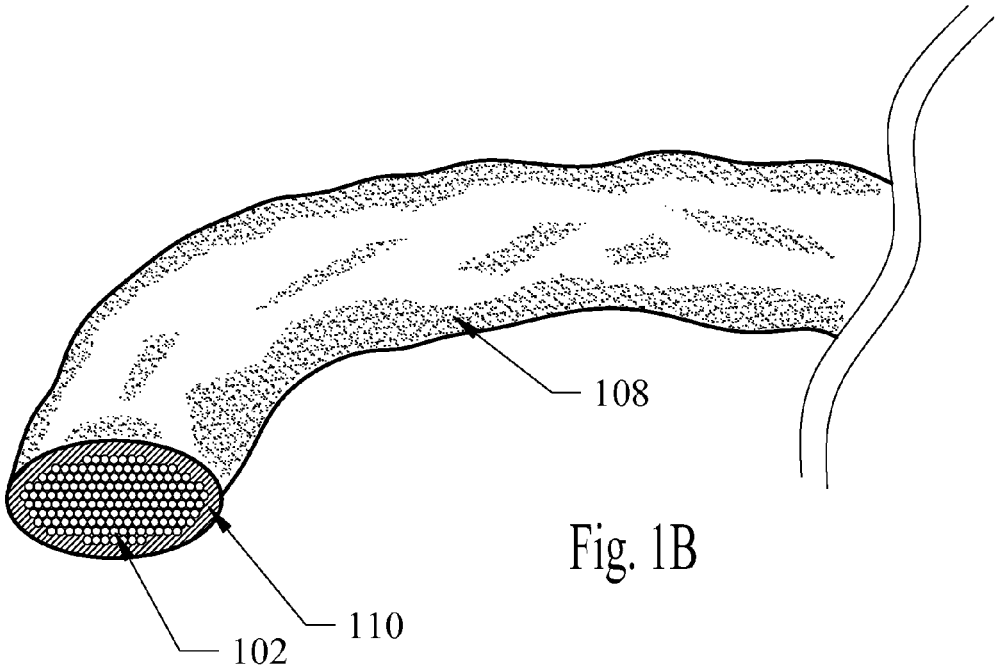
FIG. 1B there is shown a cross sectional view of a lifting sling core coated with polyurea elastomer, polyurethane, or hybrid polyurethane-polyurea elastomer.

In contrast to the prior art lifting sling 104 shown in FIG. 1A, the lifting sling 108 of the present invention is shown in FIG. 1B. Referring to FIG. 1B there is shown a cross sectional view of a lifting sling core coated with polyurea elastomer, polyurethane, or a hybrid polyurethane-polyurea elastomer.

In contrast to the prior art lifting sling 104, lifting sling 108 of the present invention, is shown as lifting sling core 102 with coating 110. In the manufacture of the lifting sling 108 of the present invention, in lieu of using the sheath 106, which is not attached in a permanent fashion to core 102, coating 110 is sprayed onto the core 102 forming a virtually inseparable tenacious bond between the lifting sling core 102 and the coating 110. The coating 110 is a polyurea elastomer, polyurethane, or hybrid polyurethane-polyurea elastomer mixture that includes any introduced additives. Core 102 can interchangeably be referred to as the lifting sling core 102, the lifting sling core materials 102, the lifting sling core fiber material 102, or the lifting sling core fibers 102. Coating 110 can be referred to as coating material 110.

An advantage in utilizing a manufacturing method of spraying the coating 110 onto the core 102, in the present invention, can be that the coating 110 forms a permanent tenacious bond with the lifting sling core 102. In this regard, the coating 110, while offering protection to the core 102, does not slip or otherwise cause destructive forces to the core 102. As a result the coating 110 is better able to remove the frictional heat generated in the core material fibers, such frictional heat can result when the lifting sling is in use.

Resultant from the adhesion between the core 102 and coating 110, another advantage of the present invention is that the lifting sling 108 grips the load better reducing slippage, which can reduce the danger, associated with heavy load lifting and or securing.

Furthermore, the utilization of coating 110 forms a permanent seal or barrier around the core 102. In this regard moisture, dirt, and contaminants are sealed away from the lifting sling core 102. As such, the abrasive effects and destructive forces that moisture, dirt, contaminants, chemicals and other agents are prevented from reaching the core 102 and potentially shortening the operational life of the lifting sling 108.

It is the physical, structural, and chemical properties of the polyurea elastomer, polyurethane, or hybrid polyurethane-polyurea elastomer compound that offers certain advantages to the lifting sling 108 of the present invention. Such physical, structural, and chemical properties can include, but not be limited to, resistance to chemicals, high shear and tensile strength, high bonding strength, resistance to sagging during application allowing precise layering and thickness control of the coating material, the ability to tenaciously bond inseparably to the fibers of the lifting sling, the ability to seal the lifting sling core such that exterior contaminants can not reach the core materials, the ability to use additives to offer additional protection to both the coating 110 and the lifting sling core 102, and the ability to remain elastic such that the coating can stretch as may be required or desired.

The polyurea coating preferably includes at least an isocyanate component and an amine or polyol-resin component. The isocyanate component in the composition may include a single isocyanate or a mixture of two or more isocyanates. Preferred isocyanate components can include, for example and not limitation, aliphatic, aromatic, monoisocyanates, diisocyanates, polyisocyanates or a combination thereof. The isocyanate component can also include in its composition optional dimers, trimers, prepolymers, and or quasi-prepolymers. A suitable isocyanate can include DESMODUR XP-7100, and or other similar, suitable, desired and or required isocyanate components.

The amount of the amine component can preferably be any suitable amount for achieving the desired amount of urea. A suitable amine component can include, for example and not limitation, CLEARLINK, DESMOPHEN NH 1220, JEFFAMINE, JEFFAMINE D-230, D400, D-2000, T-403, and or other similar, suitable, desired and or required amine components.

In addition, to utilization of the lifting sling for the lifting of loads, another exemplary embodiment of the lifting sling 108, of the present invention, can be in the utilization of securing loads on trucks and other cargo carrying vehicles (land based or otherwise including ships). In this regard, retaining slings, securing slings, and lifting slings which are used to secure cargo on vehicles can be subject to road debris, exhaust, long exposure to sun and weather, extreme temperature conditions, and other elements in the environment that can cause the lifting sling of the prior art type shown in FIG. 1A to degrade, slip, lose grip, and or deteriorate or become an operational risk that can lead to potential catastrophic failure very quickly and without forewarning.

In contrast, the lifting sling of the present invention 108 utilizing coating 110 offers superior grip and non-slip properties, with respect to securing of loads, and effectuating a permanent tenacious bond and protection barrier against external contaminates for the lifting sling core materials 102. In this regard, the lifting sling core materials 102 are sealed and protected against the outside environment and other destructive elements. These features and advantages of the lifting sling 108 of the present invention contribute to longer useful service life and reduced risk of catastrophic failure of the lifting sling 108 during operational use.

In addition to the polyurea elastomer, polyurethane, or hybrid polyurethane-polyurea elastomer coating 110 superior properties as related to high shear and tensile strength, high elasticity, chemical/contaminate resistance, and high bond strength between the elastomer and the lifting sling core materials, to name a few, the elastomer can also make use of certain additives. These additives can be integrated into the mixture during the coating process. In this regard, additives can include catalysts, stabilizers, pigments, fire retardants, and or other additives that can enhance the quality, robustness, and improve performance of the lifting sling 108 in all environments and in particular in harsh and extreme environments.

These additives in combination with the polyurea elastomer, polyurethane, or hybrid polyurethane-polyurea elastomer coating 110 can include, for example and not limitation, improved protection against ultraviolet light exposure, improved heat properties allowing the lifting sling to be operated in elevated temperature environments, improved thermal cycling effects allowing the lifting sling 108 to operate in transitional temperature environments, improved resistance to damaging chemicals, improved operational conditions, and or suitability for use by reducing the abrasive forces between the lifting sling core materials and lifted items, and improved static electricity properties by reducing the amount of static electricity that can build up in the lifting sling core materials.

With regard to ultraviolet (UV) light exposure, the use of additives in combination with the polyurea elastomer, polyurethane, or hybrid polyurethane-polyurea elastomer coating 110 can enhance the lifting slings effectiveness, by reducing the transmission of ultraviolet light rays to the lifting sling core materials. Such ultraviolet light rays can damage lifting sling materials, in particular nylon and polyester materials. A suitable UV light stabilizer can include, for example and not limitation, TINUVIN 292, TINUVIN 1130, and or other similar, suitable, desired and or required UV light stabilizer additives.

With respect to heat properties, the additives in combination with the polyurea elastomer, polyurethane, or hybrid polyurethane-polyurea elastomer coating 110 material can improve or enhance the lifting slings effectiveness allowing the lifting sling 108 to operate in environments that can expose the lifting sling to temperatures approaching 175 degrees Celsius. A suitable fire retardant can include, for example and not limitation, TRONOX 6001, and or other similar, suitable, desired and or required fire retardant additives.

With respect to static electricity, additives in combination with the polyurea elastomer, polyurethane, or hybrid polyurethane-polyurea elastomer coating 110 material can enhance the lifting sling 108, effectiveness and safety by reducing static electricity build up in the lifting sling core 102 materials. In this regard, the lifting of loads can cause static electricity to build up in a lifting slings core materials. As such, in certain environments static electric discharge can result in risk and produce dangerous conditions.

The lifting sling 108 of the present invention can utilize an additive in combination with the polyurea elastomer, polyurethane, or hybrid polyurethane-polyurea elastomer in the coating 110 to minimize the buildup of static electricity and reduce associated dangers and risks by minimizing the static electricity buildup and discharge when using the lifting sling 108 in certain environments. A suitable component for controlling static can include, for example and not limitation, KETJENBLACK EC-300J, a metal salt, a potassium salt, and or other similar, suitable, desired and or required additives for controlling static.

Additionally, another area that additives in combination with the polyurea elastomer, polyurethane, or hybrid polyurethane-polyurea elastomer coating 110 material can improve lifting sling 108 performance can include minimizing the effects of thermal cycling on the coating material and lifting sling materials. In this regard, the lifting sling core materials 102 as well as coating 110 remain flexible, non-brittle, and resistant to fatigue and or cracking in transitional temperature environments and over time when exposed to thermal cycling types of environments. A suitable thermal stabilizer can include, for example and not limitation, IRGANOX 1076, and or other similar, suitable, desired and or required thermal stabilizer additives.

In an exemplary embodiment, for example and not limitation, a pre-treatment can be applied to the lifting sling materials prior to coating. Such a pre-treatment, also referred to as a primer, can be advantageous in assisting the coating to tenaciously bond to the lifting sling core materials. In this regard, a suitable pre-treatment component for use as a pre-treatment can include, for example and not limitation, BETAGUARD, BETAGUARD 67725, and or other similar, suitable, desired and or required pre-treatment components.

In an exemplary embodiment, for example and not limitation, the polyurea elastomer, polyurethane, or hybrid polyurethane-polyurea elastomer coating 110 can be applied in one or more coats of one or more continuous or variable thickness layers. A preferred thickness on lifting sling materials can range from about 0.5 millimeters to approximately 20 millimeters, more preferably from about 1 millimeter to approximately 10 millimeters, and most preferably from about 3 millimeters to approximately 5 millimeters. The thickness may vary across the lifting sling in a random manner or according to a predetermined pattern (for example thicker in certain portions of the lifting sling). In a plurality of exemplary embodiments thickness of up to 2,000 millimeters is possible.

An advantage of the present invention lifting sling 108, 126 is that the thickness of the coating can be controlled. In this regard, the desired properties of the lifting sling can be selectable based in part on the thickness of the coating material 110. FIGS. 1J-1L and corresponding teaching below illustrate how regulating the thickness of the coating material in a predetermined pattern can be utilized to tailor the operational properties of the lifting sling 108, 126.

In an exemplary embodiment, for example and not limitation, the polyurea elastomer, polyurethane, or hybrid polyurethane-polyurea elastomer coating 110 can exhibit a Shore 'A' hardness in the range of 45-90 and more preferably in the range of 75-90, tensile strength in the range of 1,200-6,500 pounds per square inch (psi) and more preferably in the range of 1,500-2,800 psi, elongation in the range of 50-300 percent (%) and more preferably in the range of 100-160%, tear resistance in the range of 200-600 pounds per linear inch (pli) and more preferably in the range of 250-500 pli, and the coating remains flexible in the temperature range of −40 to 160 degrees Celsius and can exhibit excellent high temperature properties that can approach 175 degrees Celsius. Properties of the polyurea elastomer, polyurethane, or hybrid polyurethane-polyurea elastomer coating 110 can be tailored in a plurality of exemplary embodiments based in part on the thickness of the coating applied to the lifting sling core materials.

Furthermore, in an exemplary embodiment, for example and not limitation, the polyurea elastomer, polyurethane, or hybrid polyurethane-polyurea elastomer coating 110 can be pigmented and or colored. Such coloring can be selected to conform with industry standard color-coding as it relates to lifting slings, and or the lifting sling industry. Optionally, other pigmented and or color-coding can be selected for the coating 110 based on other criteria, standards, government regulations or policies, and or as may be required and or desired.

In an exemplary embodiment, for example and not limitation, the lifting sling materials 102 can include nylon, polyester, synthetic fibers, polypropylene, wire rope, steel core, cordage rope, yarns, NOMAX, KEVLAR, chain, and or other similar, suitable, desired and or required lifting sling materials.

Another advantage of coating material 110 being of the polyurea elastomer, polyurethane, or hybrid polyurethane-polyurea elastomer type can be that such a coating 110 can improve the operational condition, and or suitability for use of the lifting sling 108 by reducing the abrasive forces between the lifting sling core 102 materials and the lifted items. In this regard, the coating 110 being tenaciously bonded to the core 102 offers reduced slippage and superior gripping surface to protect the core materials 102 and resist scuffing, cracking, and other abrasive forces that can result during lifting sling use.

A particular advantage of using a coating that is a polyurea elastomer, polyurethane, or hybrid polyurethane-polyurea elastomer type is that while coating 110 exhibits a very high tensile strength and shear strength properties, the coating 110 remains flexible, elastic, and non-brittle. Furthermore, the coating 110 also provides superior adhesion in a permanent fashion, with the lifting sling core materials 102, and in a gripping non-slip fashion against the surfaces of the loads being lifted. As such, the lifting sling 108 of the present invention offers less slippage during use, which can translate into a safer lifting sling to use with the lifting of heavier loads, securing cargo, on loads that can be prone to slippage, and or in prolonged harsh weather environments or in extreme environmental conditions.

Figure 1C:
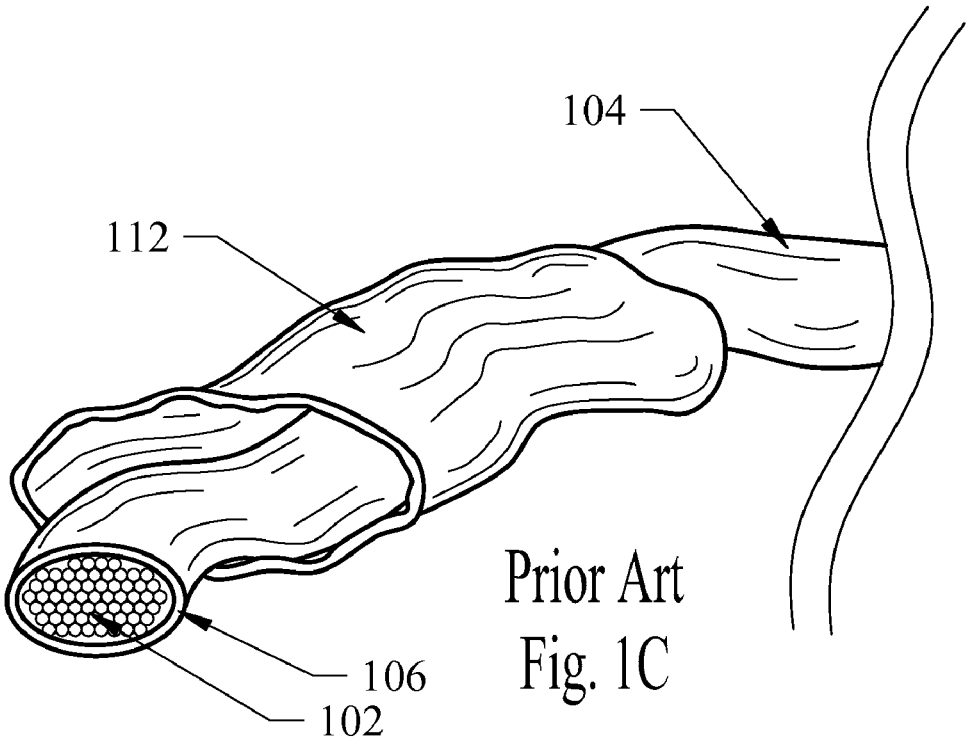
Prior Art Fig. 1C
FIG. 1C there is shown a cross sectional view of a lifting sling and a cover (PRIOR ART)

Referring to FIG. 1C there is shown a cross sectional view of a lifting sling and a cover. FIG. 1C depicts an example of a prior art style or type of lifting sling and cover. Shown in FIG. 1C is a lifting sling core 102 surrounded by a sheath 106 the combination forming a lifting sling 104. Lifting sling 104 has previously been discussed in prior art FIG. 1A. In FIG. 1C lifting sling 104 includes a cover 112.

As previously mentioned, through operation and use of the prior art lifting sling 104 problems with the prior art lifting sling 104 can include friction and slippage between core materials 102 and a sheath 106. In addition, the prior art lifting sling 104 while coming in direct contact with lifted loads can be damaged rendering the lifting sling unsuitable for use. These forces can damage the core materials and cause rapid deterioration in the suitability for use of the lifting sling 104. To extend the operational usefulness of the prior art lifting sling 104, cover 112 can be utilized. Use of cover 112 typically entails slipping the cover over prior art lifting sling 104, and in use trying to position the cover 112 on areas of the lifted load, which may cause damage to the prior art lifting sling 104. In this regard, positioning cover 112 on the corners, edges, or on sharp areas of the load can minimize the damaging effects to the prior art lifting sling 104.

Though utilization of a cover may increase the life of the prior art lifting sling 104, the cover can also cause other problems. These other problems can include, for example, increased slippage between the cover 112 and the lifted load, which can cause load slippage as well as extreme abrasion between the prior art lifting sling 104 and the cover 112. The abrasive effects can in turn cause damage between the core 102, sheath 106, and cover 112.

Figure 1D:
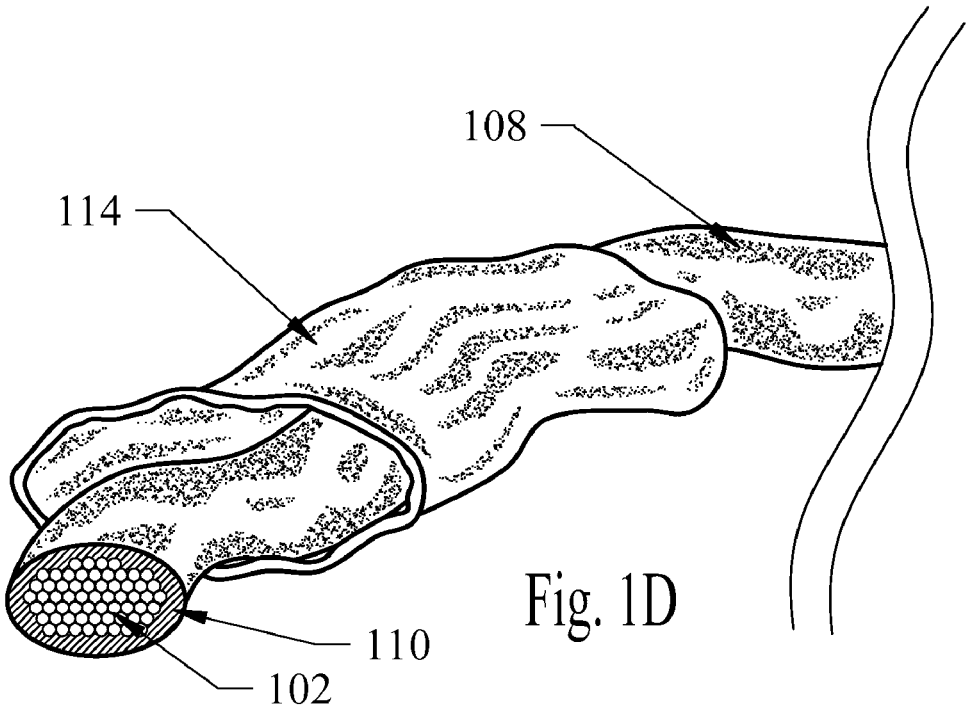
FIG. 1D there is shown a cross sectional view of a lifting sling with cover, both the sling and cover being coated with polyurea elastomer, polyurethane, or hybrid polyurethane-polyurea elastomer.

In contrast to the prior art lifting sling 104 and cover 112 shown in FIG. 1C, the lifting sling 108 and cover 114 of the present invention is shown in FIG. 1D. Referring to FIG. 1D there is shown a cross sectional view of a lifting sling 108 with a cover 114, both the lifting sling 108 and cover 114 are coated with a polyurea elastomer, polyurethane, or hybrid polyurethane-polyurea elastomer.

In contrast to the prior art lifting sling 104 with cover 112 shown in FIG. 1C, an embodiment of the present invention provides for a lifting sling 108 that includes core 102, coating 110, and cover 114. In this regard, coated cover 114 has a polyurea elastomer, polyurethane, or hybrid polyurethane-polyurea elastomer applied thereto. Once coated the cover 114 exhibits the same superior properties as coated lifting sling 108, 126. Such superior properties of the coated cover 114 can include, for example and not limitation, robust grip and non-slip features, high shear and tensile strength, excellent elasticity, chemical/contaminate resistance, and high bond strength between the polyurea elastomer, polyurethane, or hybrid polyurethane-polyurea elastomer coating and cover 114, to name a few.

In addition, one of the benefits of the polyurea elastomer, polyurethane, or hybrid polyurethane-polyurea elastomer coating being applied to the lifting sling core materials 102 and cover 114 can be that the coating 110 with additives can extend the operational usefulness and service life of the lifting sling 108, 126 as well as the cover 114. In this regard, additives can include catalysts, stabilizers, pigments, fire retardants, and or other additives that can enhance the quality of the polyurea elastomer, polyurethane, or hybrid polyurethane-polyurea elastomer coating and as such enhance the effectiveness and service life of the combination lifting sling core materials 102 and cover 114.

Figure 1E:
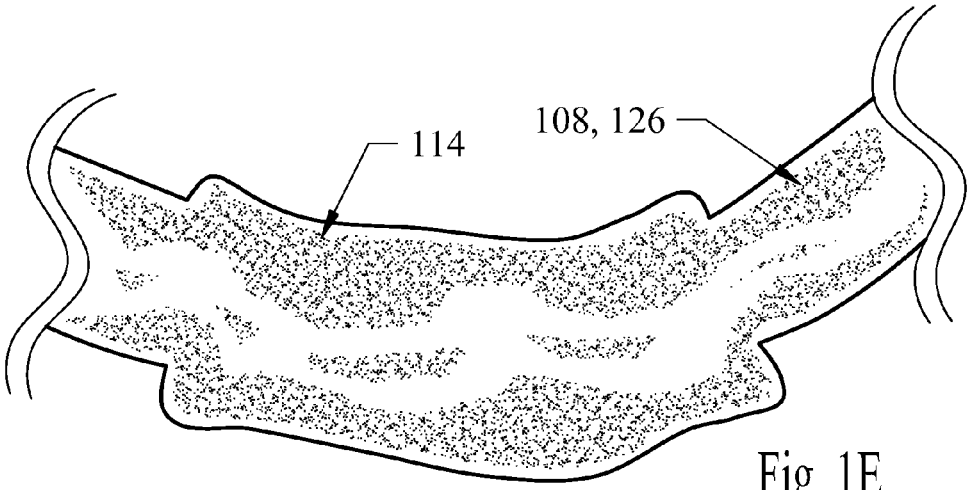
FIG. 1E there is shown a lifting sling with cover, both the lifting sling and cover being coated with polyurea elastomer, polyurethane, or hybrid polyurethane-polyurea elastomer and molded together with an additional coat of polyurea elastomer, polyurethane, or hybrid polyurethane-polyurea elastomer.

Referring to FIG. 1E there is shown a lifting sling with cover, both the lifting sling and cover being coated with polyurea elastomer, polyurethane, or hybrid polyurethane-polyurea elastomer and molded together with an additional coat of polyurea elastomer, polyurethane, or hybrid polyurethane-polyurea elastomer.

In this regard, the lifting slang 108 or a lifting sling having multiple cores 126 has a cover 114 applied thereto. For disclosure purposes a lifting sling having multiple cores 126 can be referred to as a lifting sling 108 or lifting sling 126. Furthermore, utilization of either a lifting sling 108, or multi-core lifting sling 126 can be referred to as a lifting sling 108, 126. In general, a lifting sling 126 is typically manufactured with a plurality of lifting sling 108 cores.

In the manufacture of the lifting sling, in this exemplary embodiment, once the cover 114 has been positioned on the lifting sling 108, 126 an additional coating of the polyurea elastomer, polyurethane, or hybrid polyurethane-polyurea elastomer is applied to the combination lifting sling 108, 126 and cover 114. This additional coating applied to both the lifting sling 108, 126, and cover 114 tenaciously bonds/molds the cover 114 into position on the lifting sling 108, 126.

Since the properties of the coating 110 have a high shear and tensile strength and general resistance to damage under loading and stretch conditions, coating both the lifting sling 108, 126, and cover 114 remove the degree of freedom of the cover 114 being able to slide on the lifting sling. This reduced degree of freedom of the cover 114 can result in a lifting sling 108, 126 that exhibits better gripping of the load and reduced slippage between the load and the cover. Better grip and reduced slip enables heavier loads to be lifted more safely and with reduced risk of damage to the lifting sling and or to the lifted or secured load.

Figure 1F:
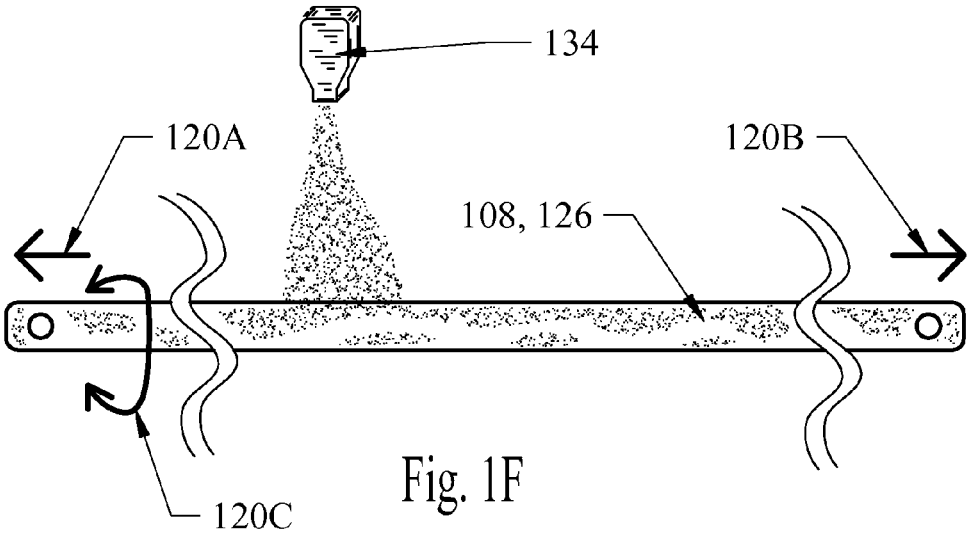
FIG. 1F there is shown a lifting sling under load during the coating process.

Referring to FIG. 1F there is shown a lifting sling under load during the coating process. It is not uncommon for a lifting sling to stretch as loads are lifted. In particular, nylon and polyester types of lifting slings tend to stretch the most. Overstretching of a lifting sling can cause permanent damage to the lifting sling. However slight deviations of stretch during a lift are common.

In a method of coating lifting sling 108, 126, in the present invention, a pre-tensioning force indicated by 120A and 120B can be applied to the lifting sling 108, 126. In this regard, prior to the coating material being applied to the lifting sling 108, 126 the lifting sling is pre-tensioned and as such stretched. In addition, this pre-tensioning force pulls the core fiber materials 102 closer together.

Typical pre-tensioning forces represented by 120A and 120B can be such that the force applied to the lifting sling is preferably within the lifting sling rated lifting limit and closer to the middle of the lifting slings rated lifting limit. As an example, if the lifting sling 108, 126 is rated to lift a maximum of a one ton load then a pre-tensioning force exerted on the lifting sling 108, 126 by pre-tensioning forces 120A and 120B can be preferably in the middle or half ton range (120A is equal to a quarter ton and 120B is equal to a quarter ton each force applied in opposite directions).

Applying the coating by way of spray device 134 to the lifting sling 108, 126 under pre-tensioning conditions indicated by 120A and 120B allows the coating to be tenaciously bonded and cured to the lifting sling core materials in such a way that under no load conditions on the lifting sling 108, 126 the coating will be in compression and under loaded conditions (in the operating range of the lifting sling) the coating material will be at or near only a slight compression or slight tension condition. Applying the coating in this manner can prevent overstretching or disproportionate stretching of the coating as related to the forces being applied to the lifting sling core materials 102 and lifting sling 108, 126 in general. As such, by avoiding overstretching or disproportionate stretching of the coating material, as related to the lifting sling core materials 102, tension or stresses to the bond between the polyurea elastomer, polyurethane, or hybrid a polyurethane-polyurea elastomer coating and the lifting sling 108, 126 core fiber materials 102 are minimized.

In an exemplary embodiment the spray device 134 can be a multi-reservoir system. In this regard, the components of the coating can be stored separately (isocyanate, amine, and optionally additives can be stored in separate chambers or compartments), and then under spray pressure can be mixed as the coating is applied to the core materials 102. Low and high air pressure spray systems can be utilized as may be required and or desired to obtain the desired coating finish. In addition, optionally a final splatter coat can be applied to add a rugged texture to the lifting coating.

Also shown in FIG. 1F is a rotational force 120C. Rotational force 120C indicates that during the coating process the lifting sling 108, 126 can be rotated such that an even distribution of coating material or a distribution regulating the thickness of the coating material in a predetermined pattern, along the surfaces of the lifting sling 108, 126 can be achieved. In an exemplary embodiment, lifting sling 108, 126 may be circular in design. As such, to effectively coat the lifting sling core materials during the coating process the lifting sling may need to be rotated, by rotational force 120C, to expose the desired surface area of the lifting sling 108, 126 to the spray device 134.

Figure 1G:
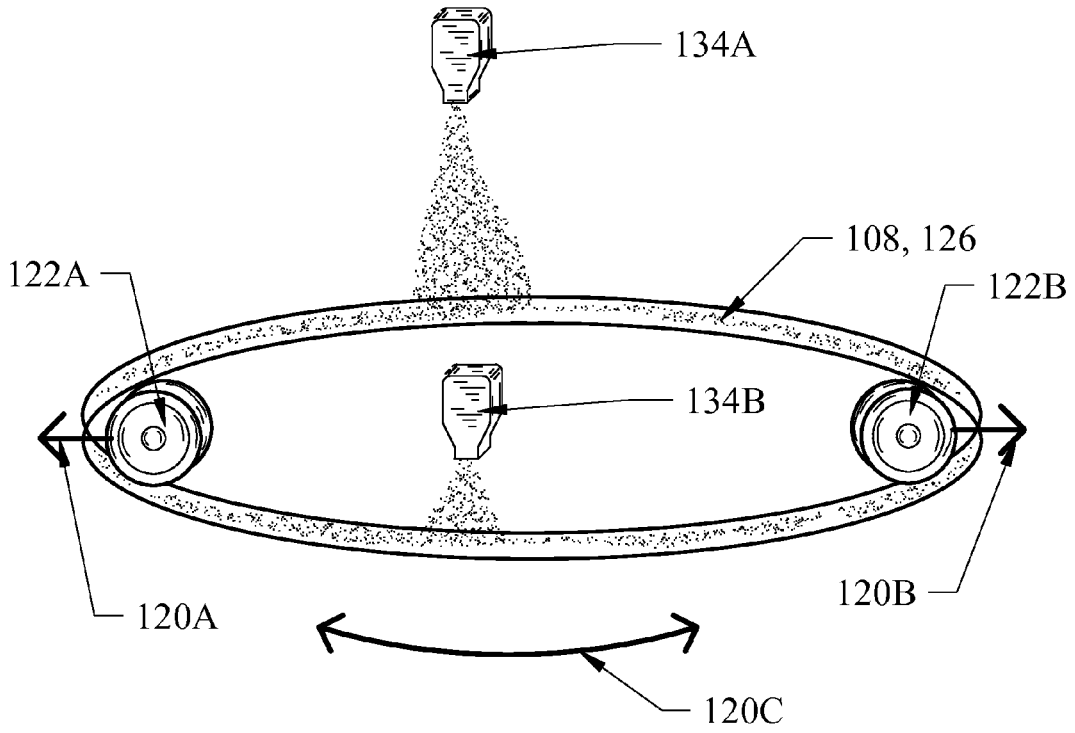
FIG. 1G there is shown a continuous loop or circular lifting sling under load during the coating process.

Referring to FIG. 1G there is shown a continuous loop or circular lifting sling 108, 126 under pre-tensioning load during the coating process. Lifting sling 108, 126 can be manufactured into a circular orientation. Such lifting slings can be referred to as circular lifting sling or circular lifting sling 108, 126. Similar to the description in FIG. 1F above during the coating process it may be required and or desired that the lifting sling 108, 126 prior to coating be placed under a pre-tensioning load. Such a pre-tensioning load is indicated by pre-tensioning force 120A applied to positioning wheel 122A, and pre-tensioning force 120B applied to positioning wheel 122B. As mentioned previously the pre-tensioning load serves to properly stretch the lifting sling. In addition, the pre-tensioning load can pull the core fiber material 102 closer together, and serve to better position the fibers of the lifting sling core materials 102.

One method of coating the circular lifting sling, of the present invention, such as circular lifting sling 108, 126 can be to position spray devices 134A and 134B such that interior and exterior surfaces of the lifting sling can be coated. An even coat of polyurea elastomer, polyurethane, or hybrid a polyurethane-polyurea elastomer, or a distribution regulating the thickness of the coating material in a predetermined pattern can then be applied to all desired or required surfaces of the circular lifting sling.

The positioning wheels 122A and 122B can be utilized to rotate the lifting sling 108, 126 in a circular fashion (shown as rotational force 120C). In this regard, the lifting sling 108, 126 can be rotationally positioned as required and or desired to effectuate a proper coating being applied to the lifting sling core materials 102, and optional safety core 130 (safety core 130 not shown in FIG. 1G).

Figure 1H:
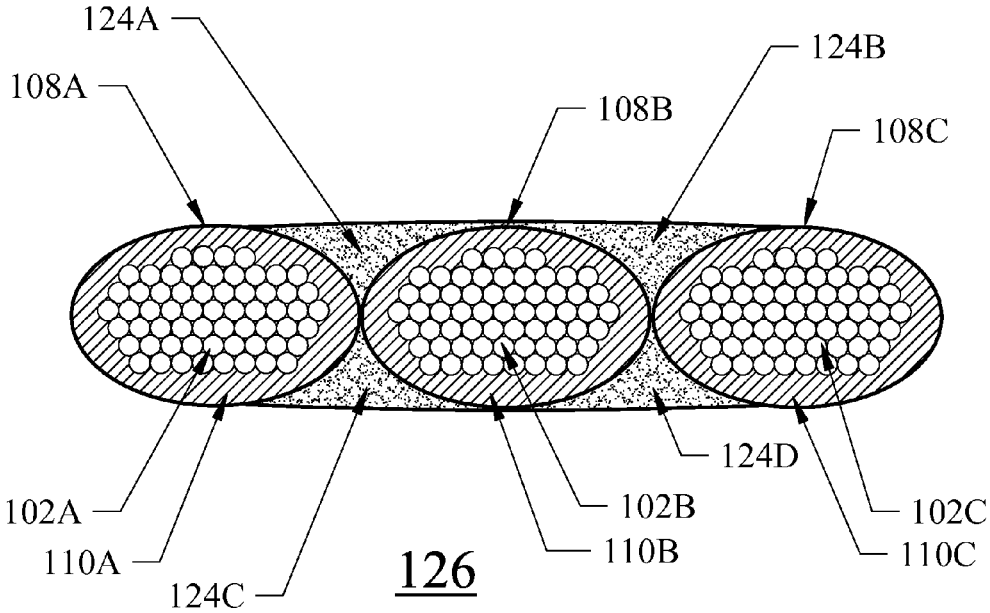
FIG. 1H there is shown the manufacture of a multi-core lifting sling utilizing a plurality of single lifting sling cores each core having been previously coated.

Referring to FIG. 1H there is shown the manufacture of a multi-core lifting sling 126 utilizing a plurality of single lifting sling cores 102 each core having been previously coated with coating 110. In an exemplary embodiment, to extend the lifting sling load or weight limit range and to better stabilize the load during the lift a multi-core lifting sling 126 can be utilized. In this regard, a plurality of coated single core 102 elements can be positioned and fused or tenaciously bonded together with an additional coating of the polyurea elastomer, polyurethane, or hybrid polyurethane polyurea elastomer in a parallel fashion to form a multi-core lifting sling 126.

In an exemplary embodiment and referring to FIG. 1H there is shown a plurality of lifting slings 108A, 108B, and 108C. In this exemplary embodiment, FIG. 1H illustrates a multi-core lifting sling 126 being manufactured with three lifting sling cores 102A, 102B, and 102C.

It should be noted that in this exemplary embodiment, for example and not limitation, three cores 102 have been utilized to form a multi-core lifting sling 126. However, in a plurality of other exemplary embodiments a multi-core lifting sling 126 can be manufactured with more or less than three lifting sling cores 102 as may be required or desired in a particular embodiment.

In this exemplary embodiment each of these cores 102A, 102B, and 102C are initially coated with a polyurea elastomer, polyurethane, or hybrid polyurethane-polyurea elastomer coating 110A, 110B, and 110C respectively. The plurality of individual lifting sling cores 102, having previously been coated and positioned in parallel fashion to form a multi-core lifting sling 126.

The individual lifting slings 108A, 108B, and 108C are tenaciously bonded together to form a multi-core lifting sling 126 with an additional seaming coat of the coating material 124A, 124B, 124C, and 124D. The seaming coat is a polyurea and elastomer, polyurethane, or hybrid polyurethane-polyurea elastomer coating similar to or the same as coating 110A, 110B, and 110C. Seaming coat 124A, 124B, 124C, and 124D is applied to the lifting slings 108A, 108B, and 108C. The seaming coat material shown as 124A, 124B, 124C, and 124D serves to tenaciously bond by fusing the individual lifting slings 108A, 108B, and 108C together.

The superior properties of the polyurea, polyurethane, or hybrid polyurethane-polyurea provides a high shear force and tensile strength coating that resists the separation of the individual lifting slings 108A, 108*b*, and 108C, as well as provides an excellent gripping and lifting surface with additional load and lifting capabilities and capacities including a greater load or weight lifting range.

As such, a multi-core lifting sling 126 has been formed by using a plurality of lifting sling cores 108A, 108B, and 108C each previously coated with the elastomer coating and then positioned to form a multi-core sling 126. Where an additional coat of the elastomer forms the multi-core lifting sling 126, which tenaciously bonds and or fuses (124A, 124B, 124C, and 124D) the individual lifting slings 108A, 108B, and 108C together.

Figure 1I:
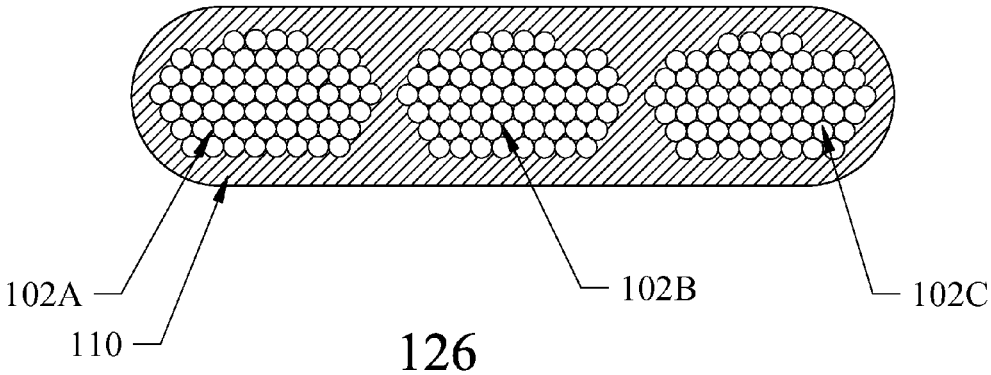
FIG. 1I there is shown the manufacture of a multi-core lifting sling utilizing a plurality of single lifting sling cores.
Figure 1J:
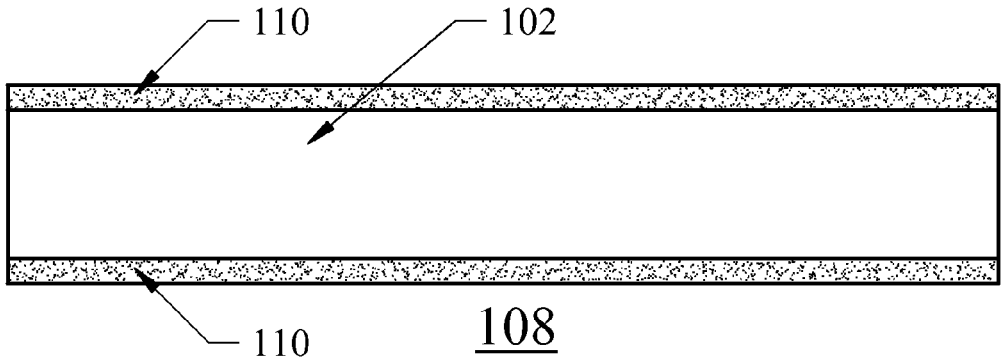
FIGS. 1J-1L show the coating of lifting sling core materials where the thickness of the coating material is regulated in a predetermined pattern to achieve the desired operational properties of the lifting sling.
Figure 1K:
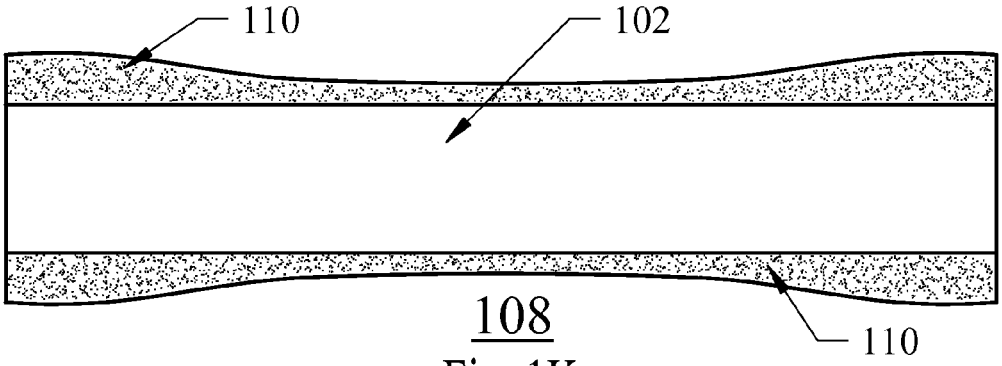
Figure 1L:
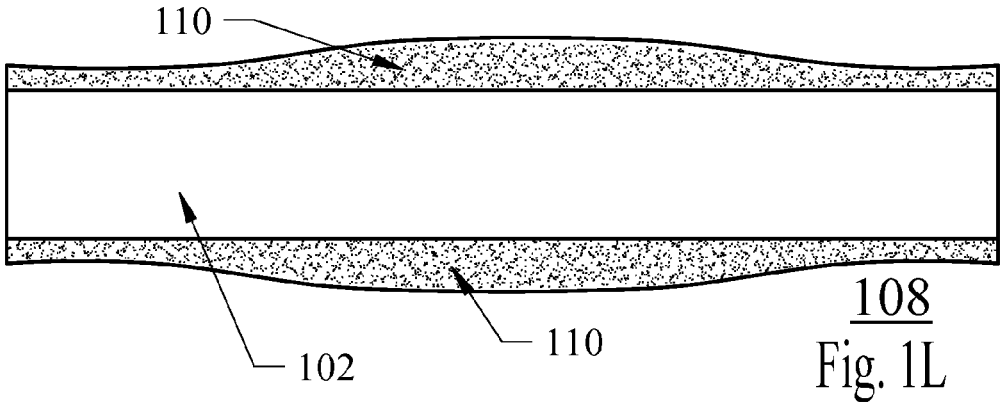

Referring to FIG. 1I there is shown the manufacture of a multi-core lifting sling 126 utilizing a plurality of single lifting sling cores 102. In this exemplary embodiment, FIG. 1I shows a multi-core lifting sling 126 being manufactured with three lifting sling cores 102A, 102B, and 102C.

It should be noted that in this exemplary embodiment, for example and not limitation, three cores 102 have been utilized to form a multi-core lifting sling 126. However, in a plurality of other exemplary embodiments a multi-core lifting sling 126 can be manufactured with more or less than three lifting sling cores 102 as may be required or desired in a particular embodiment.

In an exemplary embodiment a multi-core lifting sling 126 can be manufactured by placing a plurality of lifting sling cores, such 102A, 102B, and 102C, in parallel orientation. As previously mentioned above, and as required and or desired, the lifting sling cores 102A, 102B, and 102C can be individually prepared for coating including pre-tensioning if required or desired. A coating of polyurea elastomer, polyurethane, or hybrid polyurethane-polyurea elastomer coating can then be applied to the plurality of lifting sling cores 102A, 102B, and 102C to form a multi-core lifting sling 126.

In this exemplary embodiment the lifting sling cores 102A, 102B, and 102C need not be previously coated as is shown in FIG. 1H above. An advantage of this manufacturing technique is the elimination of the step of requiring each of the lifting sling cores 102A, 102B, and 102C to be previously coated.

Referring to FIGS. 1J-1K there is shown the coating of lifting sling core materials 102 where the thickness of the coating material 110 is regulated in a predetermined pattern to achieve the desired operational properties of the lifting sling 108, 126. In an exemplary embodiment the tenacious adhesion and bond strength of the polyurea elastomer, polyurethane, or hybrid polyurethane-polyurea elastomer coupled with the rapid dry time and resistance to sagging during application can enable the precise layering and layer placement during the coating process.

An advantage, in the present invention, of precise layering and or layer placement, can be that operational properties of the lifting sling can be tailored for varied applications, environments, and or other circumstance and or conditions the lifting sling 108 may face during use. Precise layering and or layer placement can also be referred to as regulating the thickness of the coating material in a predetermined pattern to achieve the desired operational properties of the lifting sling 108.

In an exemplary embodiment FIG. 1J illustrates a uniform coating thickness across the length of the lifting sling. The thickness of the coating can be selected to offer suitable elastomer properties given the likely applications, environments, and or other circumstances or conditions the lifting sling 108 may face during use.

For example and not limitation, a thickness of three millimeter uniformly layered across the length of the lifting sling 108 may offer a shear force of 1200 psi, high flexibility, and a suitable resistance to scuffing under normal lifting applications. In a plurality of other exemplary embodiments the thickness of the coating material can be increased to increase the shear and tensile strength, of the coating, reduce the flexibility of the lifting sling, and or as may be required or desired to tailor other operational parameters of the lifting sling 108. FIG. 1J illustrates a uniform layering of the coating material configuration.

In contrast, FIG. 1K illustrates how a thicker coating can be placed on the end portions of the lifting sling 108. In applications of the lifting sling 108 where excessive wear and tear on the lifting ends of the lifting sling 108 occurs (which can be quite common) a tailored coating of regulating the thickness of the coating material in a predetermined pattern to achieve the desired operational properties of said lifting sling 108 can include coating layering of the end portions of the lifting sling. In this regard, the thicker coating on the end portions of the lifting sling can increase the shear and tensile strength of the coating material, provide better protection of the core materials, and promote better resistance to cuts, scraping, as well as allowing tailoring of other operational parameters, to protect and extend the operational usefulness of the lifting sling 108. FIG. 1K illustrates thickened end portions of the lifting sling 108 configuration.

FIG. 1L is another exemplary embodiment of regulating the thickness of the coating material in a predetermined pattern to achieve the desired operational properties of the lifting sling 108. In this exemplary embodiment, the thickness of the coating has been tailored with a thicker coating in the center region of the lifting sling 108. A thicker coating in the center region of the lifting sling 108 can offer, for example and not limitation, increased resistance to heat, better puncture, scuff protection, better gripping, as well as allowing tailoring of other operational parameters particularly in the lifting region (lifting region is the area the lifted objects are in contact with the lifting sling) of the lifting sling 108. FIG. 1L illustrates a thickened center portion of the lifting sling 108 configuration.

In a plurality of exemplary embodiments, for example and not limitation, the thickness of the coating material 110 can be applied to the lifting sling core material 102 in a predetermined pattern to achieve the desired operational properties of the lifting sling 108. Such predetermined pattern can regulate the thickness of the coating material 110 in such a manner as to apply more or less coating material to certain portions of the lifting sling.

Figure 2A:
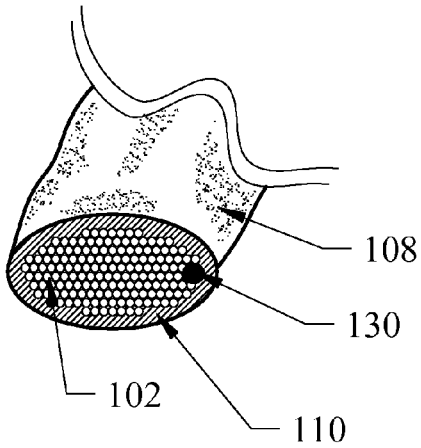
FIG. 2A there is shown a cross sectional view of a lifting sling, the lifting sling having a perimeter located safety core in the manufacture of the lifting sling.

Referring to FIG. 2A there is shown a cross sectional view of a lifting sling 108, 126, the lifting sling 108, 126 having a perimeter located safety core 130 in the manufacture of the lifting sling 108, 126. In an exemplary embodiment a safety core 130 can be positioned in close proximity and traversing the length of the lifting sling 108, 126 core fiber materials 102. The lifting sling coating 110 can be applied to both the lifting sling core material 102 and the safety core 130. The coating 110 effectively secures by tenaciously bonding or fusing the safety core 130 that traverses the length of the lifting sling 108, 126, to the lifting sling core materials 102.

In an exemplary embodiment a single safety core 130 is utilized to traverse the single core 130 fiber member 102. In such a configuration as shown in FIG. 2F the safety core can be interconnected with at least one indicator 132A, 132B and or an electronic system 500A, 500B.

In an exemplary embodiment the safety core 130 can contain a substance suitable for the facilitation of monitoring, and or for indicating the operational fitness or suitability for use of the lifting sling 108, 126. Such a substance can be a solid, liquid, gas and or other similar or suitable substance.

In this regard, the safety core 130 can effectuate the ability to monitor certain operational parameters. Such operational parameters can include, for example and not limitation, temperature, pressure, tension, force, optical transmission, electrical transmission, chemical, volume, and or conductance to name a few. In this regard, by monitoring certain operational parameters methods of determining the operational condition, and or suitably for use of the lifting sling 108, 126 can be implemented.

For example and not limitation, in an exemplary embodiment where the operational parameter being monitored is conductance, a safety core 130 can be an electrical conductor such as a wire and or other similar, suitable required and or desired electrical conductor. In this regard, conductance of the safety core 130 can be utilized as at least one method of determining the operational condition, and or suitably for use of the lifting sling 108, 126.

One advantage of the perimeter located safety core 130 is that the safety core 130, being positioned close to the outer edge of the core fiber materials 102, is subjected to more of the environmental conditions such as heat, chemicals, and other environmental conditions that can damage the lifting sling 108.

In an exemplary embodiment the safety core 130 in this perimeter located configuration is subjected to the same forces that the lifting sling 102 encounters. As such, by monitoring the state of the safety core 130 by way of an indicator (such as indicator 132 shown in FIG. 2J) or an electronic system (such as electronic system 500 shown in FIG. 2I) a determination can be made as to the operational condition, and or suitability for use of the lifting sling 108, 126.

More specifically, by monitoring the integrity and status of the safety core 130 a determination can be made as to the suitability of the lifting sling core materials 102. If such determination is in the negative, that is indications are that the safety core 130 has been damaged in some way or breeched the resulting indication can be made by way of indicator 132, electronic system 500, or by allowing the substance inside the safety core to mark the lifting sling 108 at the rupture or breech indicating that the lifting sling 108, 126 is not operationally sound and should be removed from service.

Conversely, if such a determination is in the affirmative, that is indications are that the safety core 130 has not been damaged in some way or breached the resulting indication can be made by the indicator 132, electronic system 500, or other similar or suitable means that the lifting sling is operationally sound and ready for use.

In an exemplary embodiment the safety core 130 can contain a substance suitable for the facilitation of monitoring, and or for indicating the operational fitness or suitability for use of the lifting sling 108. Such a substance can be a solid, liquid, gas and or other similar or suitable substance.

In this regard, the safety core 130 can effectuate the ability to monitor certain operational parameters. Such operational parameters can include, for example and not limitation, temperature, pressure, tension, force, optical transmission, electrical transmission, chemical, volume, and or conductance to name a few. In this regard, by monitoring certain operational parameters methods of determining the operational condition, and or suitably for use of the lifting sling 108, 126 can be implemented.

For example and not limitation, in an exemplary embodiment where the operational parameter being monitored is conductance, a safety core 130 can be an electrical conductor such as a wire and or other similar, suitable required and or desired electrical conductor. In this regard, conductance of the safety core 130 can be utilized as at least one method of determining the operational condition, and or suitably for use of the lifting sling 108, 126.

During operation the safety core 130 can stretch, flex, bend and be subjected to the same forces and environmental conditions that the lifting sling core materials 102 are subjected too. A rupture or excessive stretching of the safety core 130 can allow the conditions associated with the safety core 130 to change. Such a change can be a result of the escaping substance from the safety core 130 leaking out of the rupture or melt, and or otherwise breech an area or break the safety core 130. In addition, the change can be resultant from a force that has produced an undo elongation of the safety core 130. In such a case of undo elongation of the safety core 130 the resultant can be the creation of a larger volume of space available for the substance to occupy. As such, the larger volume of space can result in a decrease in pressure and or an increase in volume within the safety core 130. The pressure change can be detected by way of the indicator 132, and or the electronic system 500 and optionally communicated to a user by way of an indicator, a display, and or other similar or suitable user interface.

In a plurality of other exemplary embodiments the safety core 130, being perimeter located and tenaciously bonded by way of coating 110 to the core fiber materials 102, can be utilized in a plurality of other ways, all of which are focused on utilizing the safety core 130 as a way of monitoring the operational suitability and fitness for use of the lifting sling 108, 126.

Figure 2B:
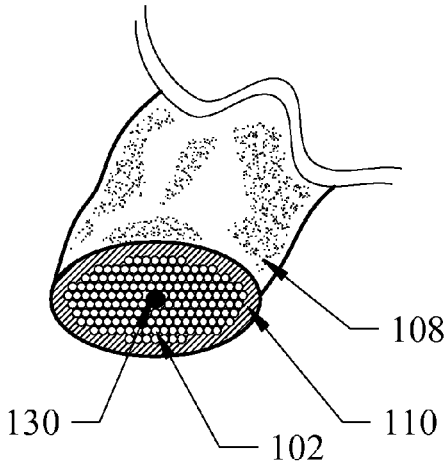
FIG. 2B there is shown a cross sectional view of the inclusion of a single safety core centrally located in the manufacture of the lifting sling.

Referring to FIG. 2B there is shown a cross sectional view of the inclusion of a single safety core 130 centrally located in the manufacture of a lifting sling 108, 126. As previously described in FIG. 2A, the safety core 130 is utilized to monitor the operational status and suitability for use of the lifting sling 108. In this embodiment the safety core 130 has been positioned centrally in the core fiber materials 102.

In an exemplary embodiment a single safety core 130 is utilized to traverse the length of the single core fiber materials 102. Such a configuration is shown in FIG. 2F where the safety core 130 can be terminated by at least one indicator 132A, 132B and or electronic system 500A, 500B.

In an exemplary embodiment a safety core 130 can be positioned in the center of the lifting sling 108 core fiber materials 102. The lifting sling coating 110 can be applied to both the lifting sling core materials 102 and the safety core 130. The coating 110 effectively secures the safety core 130 into the center of the core fiber materials 102, which allows the safety core 130 to traverse the length of the lifting sling, in close proximity to the center of the lifting sling core materials 102.

One advantage of a centrally located safety core 130 can be that the safety core 130 is subjected to forces, traumas, and environmental conditions such as heat, chemicals, and other environmental conditions that the center of the core fiber materials 102 is subjected too. In addition, the centrally located safety core 130 can result in a more accurate measurement of the forces applied to the lifting sling 108, 126. In this regard, where perimeter located safety cores 130 might be pinched on the close side of the load and over stretched on the far side of the load the centrally located safety core 130 is subjected to a more even force at the center of the core materials 102 regardless of sling position or orientation on the lifted load.

Another advantage of the centrally located safety core 130 can be that the centrally located safety core 130 is not subjected to edge crushing, and or pinching forces that the perimeter located safety core 130 shown in FIG. 2A may be subjected too.

Figure 2C:
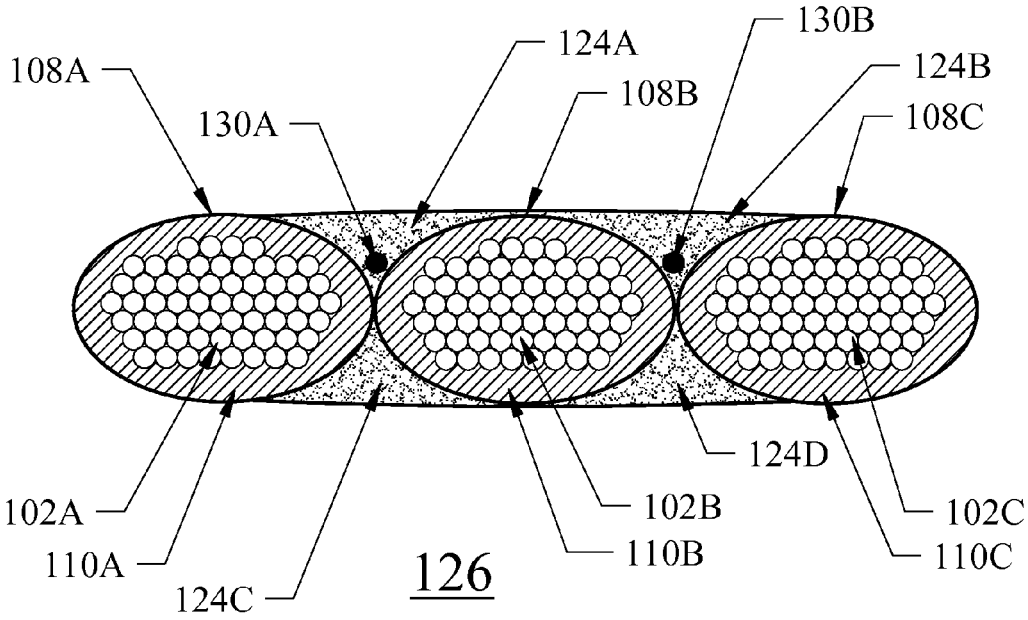
FIG. 2C there is shown a cross sectional view of the inclusion of a plurality of seam located safety cores in the manufacture of a multi-core lifting sling.

Referring to FIG. 2C there is shown a cross sectional view of the inclusion of a plurality of seam located safety cores 130 in the manufacture of a multi-core lifting sling 126.

In an exemplary embodiment either a single safety core 130A, 130B or plurality of safety cores 130A and 130B can be utilized during the tenacious bonding and fusing of a plurality of lifting slings 108, and or a plurality of core materials 102 into a multi-core lifting sling 126. In this regard, the safety cores 130A and 130B can be positioned in the seams between the individual lifting sling members 108A, 108B, and 108C. Once positioned the seaming coat 124A, 124B, 124C, and 124D can be applied tenaciously bonding and or fusing the individual lifting sling members 108 together, forming the multi-core lifting sling 126.

In this exemplary embodiment three separate core fiber members 108A, 108B, and 108C have been shown. In a plurality of other exemplary embodiments a plurality of more than or less than three separate core fiber members can be utilized in the manufacture of a multi-core lifting sling 126. Furthermore, safety cores 130A and 130B can be interchangeably seam located, perimeter located, centrally located, and or located in other positions within the multi-core lifting sling 126. In this regard, the location of the safety cores can be chosen to best enable accurate monitoring, indicating, manufacturing of the multi-core lifting sling 126, and or as may be required and or desired in a plurality of exemplary embodiments.

Figure 2D:
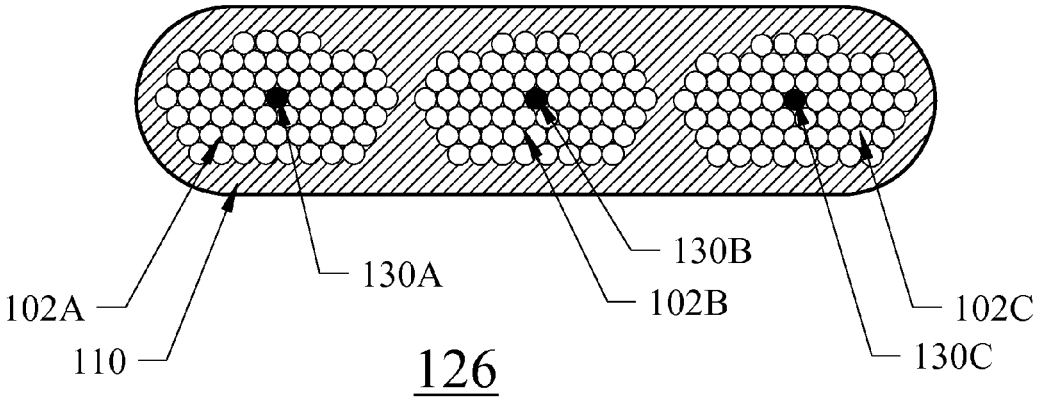
FIG. 2D there is shown a cross sectional view of the manufacture of a multi-core lifting sling with the inclusion of a plurality of safety cores, the safety cores being shown centrally located in each lifting sling core member.

Referring to FIG. 2D there is shown a cross sectional view of the manufacture of a multi-core lifting sling 126 with the inclusion of a plurality of safety cores 130, the safety cores being shown centrally located in each core member. In similar form and function as the safety core 130 shown in FIGS. 2A and 2B, safety cores 130A, 130B, and 130C can be added to the manufacture of a multi-core lifting sling 126. As such, the individual safety cores 130A, 130B, and 130C can be monitored by way of an indicator (such as indicator 132 shown in FIG. 2J), by an electronic system (such as electronic system 500 shown in FIG. 2I), and or by other similar, suitable, required or desired monitoring and or indicating means.

In an exemplary embodiment mutually exclusive safety cores 130A, 130B, and 130C can be positioned centrally located in a plurality of core material fibers 102A, 102B, and 102C. Since each safety core 130A, 130B, and 130C are monitored individually a breach in one of the safety cores 130A, 130B, and or 130C is not detectable by the other safety cores. As such a determination can be made as to which core fiber material 102A, 102B, and or 102C has been compromised.

In this exemplary embodiment three separate core fibers 102A, 102B, and 102C have been shown. In a plurality of other exemplary embodiments a plurality of more than or less than three separate core fiber members can be utilized. In this regard, a plurality of more or less than three safety cores can also be utilized. Furthermore, safety cores 130A, 130B, and 130C can be interchangeably seam located, perimeter located, centrally located, and or located in other positions within the multi-core lifting sling 126. In this regard, the location of the safety cores can be chosen to best enable accurate monitoring, indicating, manufacturing of the multi-core lifting sling 126, and or as may be required and or desired in a plurality of exemplary embodiments.

In an exemplary embodiment utilizing a plurality of mutually exclusive safety cores, such as safety cores 130A, 130B, and 130C each core can traverse the length of a single core fiber member 102A, 102B, and 102C. Such a configuration is shown in FIG. 2G where the safety cores 130A, 130B, and 130C are shown terminated by an indicator 132 and or electronic system 500. In this regard, safety core 130A is shown traversing multi-core lifting sling member 108A, 126A, safety core 130B is shown traversing multi-core lifting sling member 108B, 126B, and safety core 130C is shown traversing multi-core lifting sling member 108C, 126C.

Figure 2E:
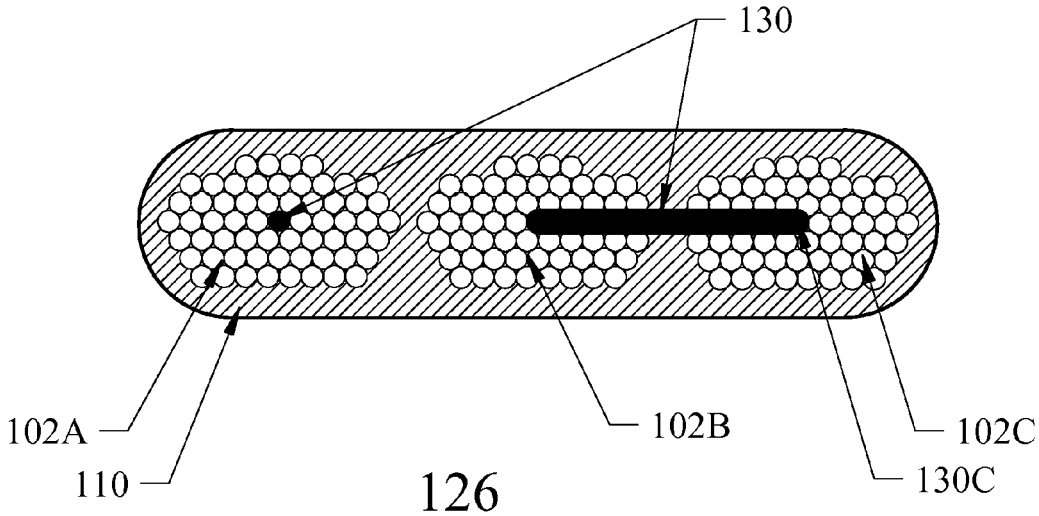
FIG. 2E there is shown a cross sectional view of the manufacture of a multi-core lifting sling with the inclusion of a single safety core traversing the length of each lifting sling core member, the safety core being shown centrally located in each lifting sling core member.
Figure 2F:
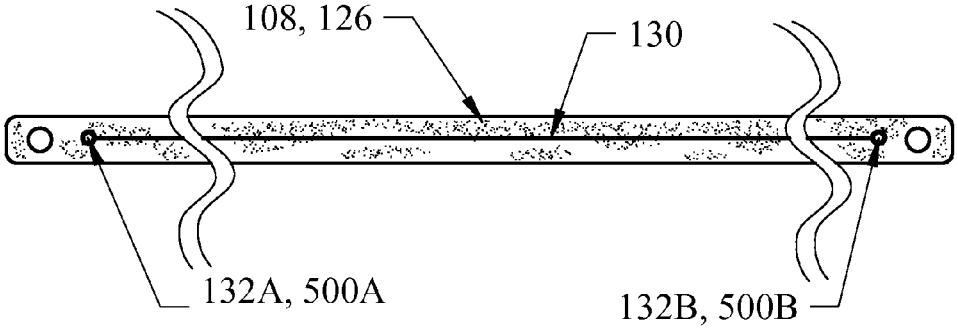
FIG. 2F there is shown a lifting sling having a safety core traversing the length of the lifting sling and having an optional indicator on both ends of the lifting sling.
Figure 2G:
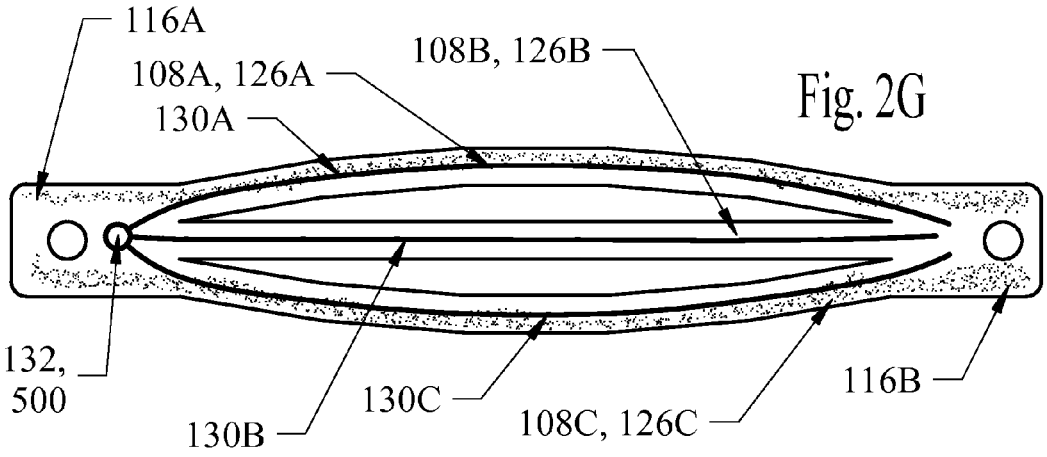
FIG. 2G there is shown a multi-span lifting sling having a plurality of safety cores originating from a central indicator, and or electronic system, each safety core individually traversing the length of a single span of the multi-span lifting sling.

Referring to FIG. 2E there is shown a cross sectional view of the manufacture of a multi-core lifting sling 126 with the inclusion of a single safety core 130 traversing the length of each core, the safety core 130 being shown centrally located in each core member 102A, 102B, and 102C. In this exemplary embodiment, instead of utilizing a plurality of safety cores 130 a single safety core 130 traverses the length of each of the plurality of core fiber members 102A, 102B, and 102C.

In this exemplary embodiment three separate core fiber members 102A, 102B, and 102C have been shown. In a plurality of other exemplary embodiments a plurality of more than or less than three separate core fiber members can be utilized. Furthermore, safety core 130 can be interchangeably seem located, perimeter located, centrally located, and or located in other positions within the multi-core lifting sling 126. In this regard, the location of the safety cores can be chosen to best enable accurate monitoring, indicating, manufacturing of the multi-core lifting sling 126, and or as may be required and or desired in a plurality of exemplary embodiments.

Figure 2H:
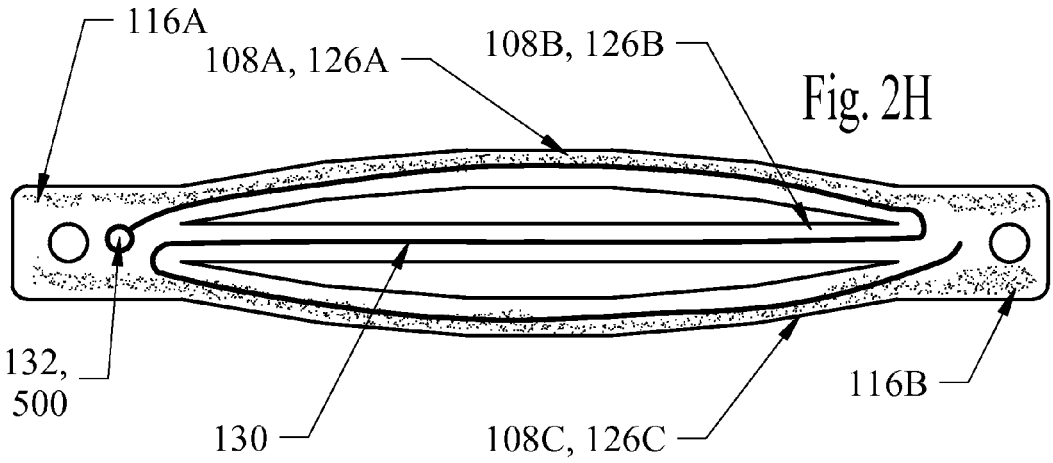
FIG. 2H there is shown a multi-span lifting sling having a single safety core originating from a central indicator, and or electronic system, the safety core traverses the length of each span of the multi-span lifting sling in a continuous manner.

In an exemplary embodiment a single safety core 130 is utilized to traverse each of the plurality of single core fiber members 102A, 102B, and 102C. Such a configuration is shown in FIG. 2H where the safety core 130 is terminated by an indicator 132 and or electronic system 500, safety core 130 is shown traversing the length of each of the multi-core lifting sling members 108A, 126A, 108B, 126B, and 108C, 126C.

Referring to FIG. 2F there is shown a lifting sling 108, 126 having a safety core 130 traversing the length of the lifting sling 108, 126 and having an indicator 132A, 500A, 132B, 500B positioned optionally on both ends of the lifting sling 108, 126. In an exemplary embodiment a plurality of indicators 132A, and 132B and or a plurality of electronic system 500A, and 500B can be interconnected with a safety core 130. The safety core 130 can optionally be seam located, perimeter located, centrally located, and or located in other positions within the lifting sling 108, 126. In this regard, the location of the safety cores can be chosen to best enable accurate monitoring, indicating, manufacturing of the lifting sling 108, 126, and or as may be required and or desired in a plurality of exemplary embodiments.

Referring to FIG. 2G there is shown a multi-span lifting sling having a plurality of safety cores 130A, 130B, and 130C originating from a central indicator 132, and or electronic system 500, each safety core 130 individually traverses the length of a single span of the multi-span lifting sling 108, 126.

In an exemplary embodiment an indicator 132 and or an electronic system 500 can be interconnected with a plurality of safety cores 130A, 130B, and 130C. In this regard, each of the safety cores 130A, 130B, and 130C can traverses the length of the lifting sling number 108A, 126A, 108B, 126B, and 108C, 126C respectively. By way of the indicator 132 and or electronic system 500 certain determinations can be made as to the operational condition, and or suitability for use of the multi-span lifting sling 108, 126.

In addition, the formed ends of the lifting sling shown as 116A and 116B can be formed having eyes for interconnecting the lifting sling with a hook or latch. The formed eyes can also be referred to as 'eye-to-eye'. In an exemplary embodiment such as that shown in FIG. 3C the formed ends of the lifting sling 116A and 116B can be placed on a hook, latch, or other lifting device such that the sling can be utilize to maneuver and lift the desired loads.

The individual lifting sling members 108A, 126A, 108B, 126B, and 108C, 126C can be formed into a multi-core lifting sling 126 by way of a seaming coat and methods described above and illustrated in FIGS. 1H, 1I. The lifting sling can utilize partial or full seaming. The partial seaming techniques tenaciously bonds or fuses the ends of the multi-core lifting sling into a single sling body as shown in FIG. 2F. A full seaming bonds or fuses the entire length of the multi-core lifting sling 126 into a single lifting sling body as is illustrated in FIG. 2G.

Advantages of a partial seaming can include the ability to locate the individual multi-core lifting sling members in a distributed fashion around the load. In this regard, distributing the force applied to the load during the lift can reduce the chances of damaging the lifted object by crushing, it can also prevent load slippage, and or minimize shifting of the load.

Referring to FIG. 2H there is shown a multi-span lifting sling 108, 126 having a single safety core 130 originating from a central indicator 132, and or electronic system 500, the safety core 130 traverses the length of each span of the multi-span lifting sling 108, 126 in a continuous manner.

In an exemplary embodiment an indicator 132, and or an electronic system 500 can be interconnected with a single safety core 130. In this regard, the safety core 130 can traverse the length of the lifting sling member 108A, 126A, 108B, 126B, and 108C, 126C. By way of the indicator 132, and or electronic system 500 certain determinations can be made as to the operational condition, and or suitability for use of the multi-span lifting sling 108, 126.

With respect to FIGS. 2G and 2H, in this exemplary embodiment three separate span members 108A, 126A, 108B, 126B, and 108C, 126C have been shown. In a plurality of other exemplary embodiments a plurality of more than or less than three separate lifting sling span members can be utilized. Furthermore, safety core 130 can be interchangeably seam located, perimeter located, centrally located, and or located in other positions within the lifting sling 108, 126. In this regard, the location of the safety cores can be chosen to best enable accurate monitoring, indicating, manufacturing of the lifting sling 108, 126, and or as may be required and or desired in a plurality of exemplary embodiments.

Figure 2I:
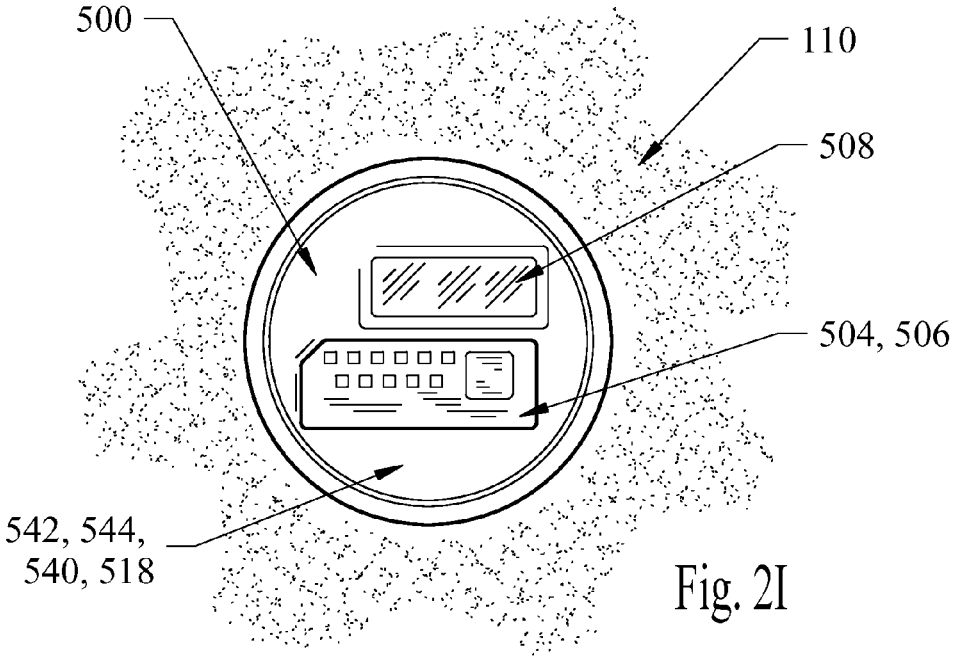
FIG. 2I there is shown an electronic system 500 embedded in a lifting sling.

Referring to FIG. 2I there is shown an electronic system 500 embedded in a lifting sling. In an exemplary embodiment electronic system 500 can be positioned, bonded, fused, molded or otherwise fastened onto the lifting sling 108, 126. Optionally coating 110 can be utilized to secure and protect the electronic system 500 and any interconnection to the electronic system 500 that may be present. In this regard, the electronic system 500 can be interconnected to the safety core 130, and or other devices and interfaces as may be required and or desired.

In an exemplary embodiment an identification tag or plate can also be molded or otherwise fastened to the lifting sling. In this regard, an identification tag, in accordance with applicable industry practice, standards, laws, or otherwise, can be secured by molding or fastening the identification tag in place on the lifting sling with the aid of the coating material.

The electronic system 500 can provide user information and data communication functionality by way of the various interface features 542, communication features/devices 544, and or processing features 540. Such user interface features can include, for example and not limitation, a graphical user interface 504, a keypad/touch pad/general purpose input output interface 506, a display/indicators/user input 508, and or other similar, suitable, desired and or required user interface features.

Figure 2J:
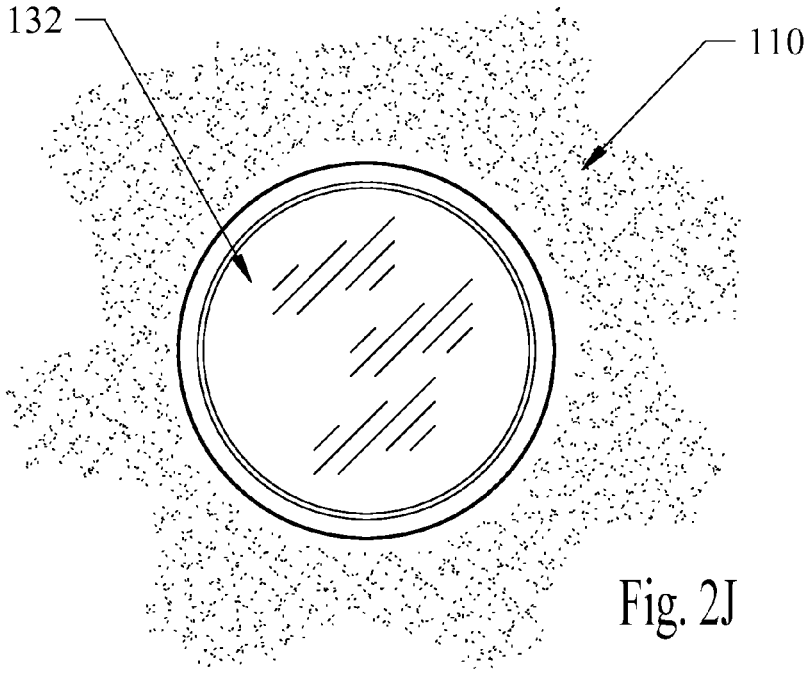
FIG. 2J there is shown an indicator 132 embedded in a lifting sling.

Referring to FIG. 2J there is shown an indicator 132 embedded in a lifting sling. An indicator 132 can be mechanical, chemical, electrical, non-electrical indicator, and or similar, suitable, desired and or required types of indicators. In this regard, the indicator 132 can be positioned, bonded, molded, and or otherwise fastened onto the lifting sling 108, 126. Optionally coating 110 can be utilized to secure and protect the indicator 132 and any interconnections to the indicator 132 that may be present.

In an exemplary embodiment an identification tag or plate can also be molded or otherwise fastened to the lifting sling. In this regard, an identification tag, in accordance with applicable industry practice, standards, laws, or otherwise, can be secured by molding or fastening the identification tag in place on the lifting sling with the aid of the coating material.

In an exemplary embodiment indicator 132 is interconnected with at least one safety core 130. The indicator 132 can be utilized to indicate the status or condition of the interconnected safety core 130, and by way of the safety core 130 proximity to the core fiber materials 102, within the lifting sling 108, 126, the status or condition of the lifting sling 108, 126. In this regard, the indicator 132 can indicate whether or whether not the lifting sling is operationally sound and suitable for use as well as indicate other conditions, parameters, and or properties.

In an exemplary embodiment, the lifting sling indicator 132 is preferably a mechanical, chemical, electrical, and or pressure sensitive device. Though in a plurality of other embodiments the indicator 132 can be of a plurality of different kinds or types of indicators as may be required and or desired in a particular configuration or embodiment.

In an embodiment utilizing an indicator 132 that is responsive to pressure, such deviations or changes in pressure can be a result of the forces applied to the lifting sling 108, 126. The pressure changes within the interconnected safety core 130 can be monitored and relied upon to determine if trauma, damage, and or other conditions that could compromise the lifting sling 108, 126 have occurred. The indicator 132 by monitoring these deviations and or changes can make certain determinations and indications as to whether the lifting sling 108, 126 is operational sound and ready for use.

Figure 2K:
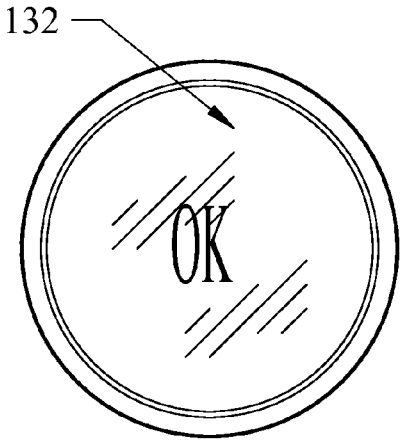
FIG. 2K there is shown an indicator 132 indicating the lifting sling is 'OK' for use.

Referring to FIG. 2K there is shown an indicator 132 indicating the lifting sling is 'OK' for use. In an exemplary embodiment, the indicator 132 can simply indicate by an 'OK' message or other indicia that the lifting sling 108, 126 is operationally sound and ready for use. This condition could suggest that the safety core 130 is in tact, in range, operational, that the mechanism by way such determinations of the health and suitability of the lifting sling 108, 126 have not been compromised, and that the lifting sling 108, 126 appears operationally sound and ready for use.

Figure 2L:
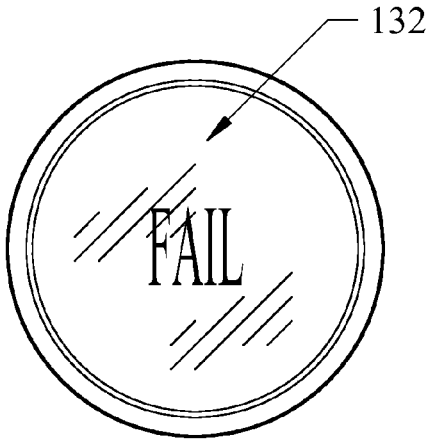
FIG. 2L there is shown an indicator 132 indicating the lifting sling is not safe for use and should be taken out of service—'FAIL'.

Referring to FIG. 2L there is shown an indicator 132 indicating the lifting sling is not safe for use and should be taken out of service—'FAIL'. In an exemplary embodiment, the indicator 132 can simply indicate by a 'FAIL' message or other indicia that the lifting sling 108, 126 is not operationally sound and should be removed from service. This condition could suggest that the safety core 130 has been breached or otherwise compromised and that the mechanism by which such determinations of health and suitability of the lifting sling 108, 126 have been compromised and that the lifting sling 108, 126 should be removed from service.

In an exemplary embodiment, multi-core lifting slings can be fabricated in one of two ways. In a first way a seaming coat can be applied to a plurality of single lifting sling core members and as such tenaciously bond or fuse the plurality of single cores along the entire length of the cores forming a single multi-core lifting sling 126. Such methods of forming a multi-core lifting sling in this manner have been previously discussed and shown in the Figures above and in particular illustrated in FIG. 2F.

Figure 3A:
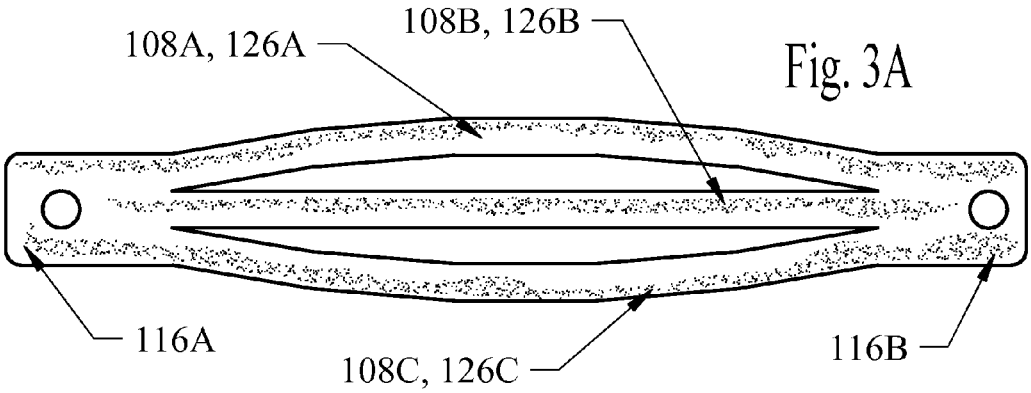
FIG. 3A there is shown a multi-span lifting sling having separate single cores in mid-span of the lifting sling.

FIG. 3A illustrates a second way to manufacture a multi-core lifting sling. Referring to FIG. 3A there is shown a multi-span lifting sling 108, 126 having separate cores 108A, 126A, 108B, 126B, and 108C, 126C in mid-span of the lifting sling.

In this exemplary embodiment only the end area 116A, and 116B of the lifting sling are fused together by a seaming coat. This leaves the mid-span area un-fused and free moving. This can allow each of the plurality of lifting sling members 108A, 126A, 108B, 126B, and 108C, 126C to remain unencumbered, separate, and individually positionable on the lifted load.

One advantage of this configuration is that the individual lifting sling core members can be separated and positioned as to distribute the force on the lifted load. Distributing the force of the lifted load can prevent crushing damage on the lifted load itself. In addition, by disturbing the force on the lifted load the lifting sling can effectuate a better grip on the load while reducing the potential for slippage of the load during the lift. Therefore an advantage of the multi-span lifting sling is that instead of lifting the load and concentrating the lifted force in a single area on the lifted items the multi-span can distribute the load force across a wider surface area of the lifted items reducing potential damage to the lifted load and reducing the potential for slippage of the load during the lift.

Figure 3B:
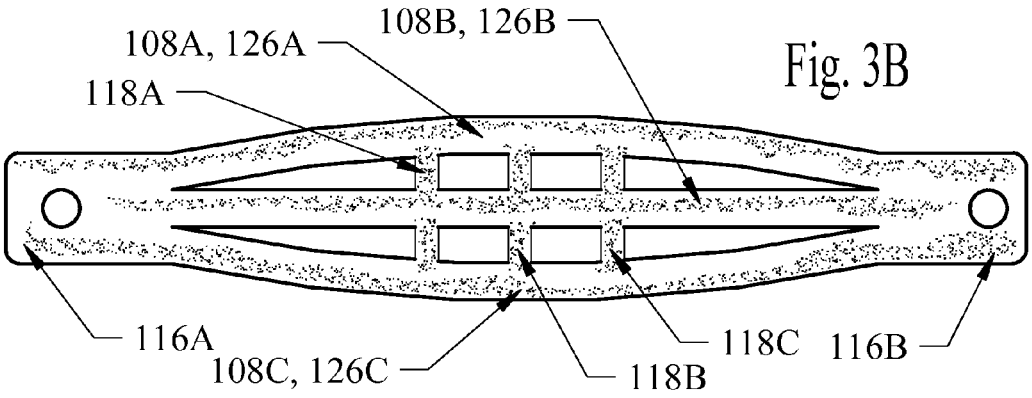
FIG. 3B there is shown a multi-span lifting sling having separate single cores in mid-span of the lifting sling and further having interconnected ribs.

Referring to FIG. 3B there is shown a multi-span lifting sling having separate single cores in mid-span of the lifting sling and further having interconnecting ribs. Similar to the lifting sling configuration shown in FIG. 3A, FIG. 3B illustrates the lifting sling having ribbed areas 118A, 118B, and 118C. In this regard, the ribbed areas prevent the multi-spans from moving too far apart during the lift. As such the interconnecting ribs 118A, 118B, and 118C in combination with the multi-spans form a basket. The basket portion of the lifting sling can be secure around the load to facilitate a better grip, while reducing the chance of slippage during the lift. In addition, in an exemplary embodiment the interconnected ribs 118A, 118B, and 118C can prevent the multi-span core 108A, 126A, 108B, 126B, and 108C, 126C from separating during the lift.

Each of the ribbed areas 118A, 118B, and 118C can be fabricated by positioning lifting sling core materials into position between the multi-span cores 108A, 126A, 108B, 126B, and 108C, 126C and utilizing the coating processes described above to secure them in place and protect them from damage.

With respect to FIGS. 3A and 3B, in this exemplary embodiment three separate span members 108A, 126A, 108B, 126B, and 108C, 126C have been shown. In a plurality of other exemplary embodiments a plurality of more than or less than three separate lifting sling span members and or interconnecting ribs can be utilized.

Figure 3C:
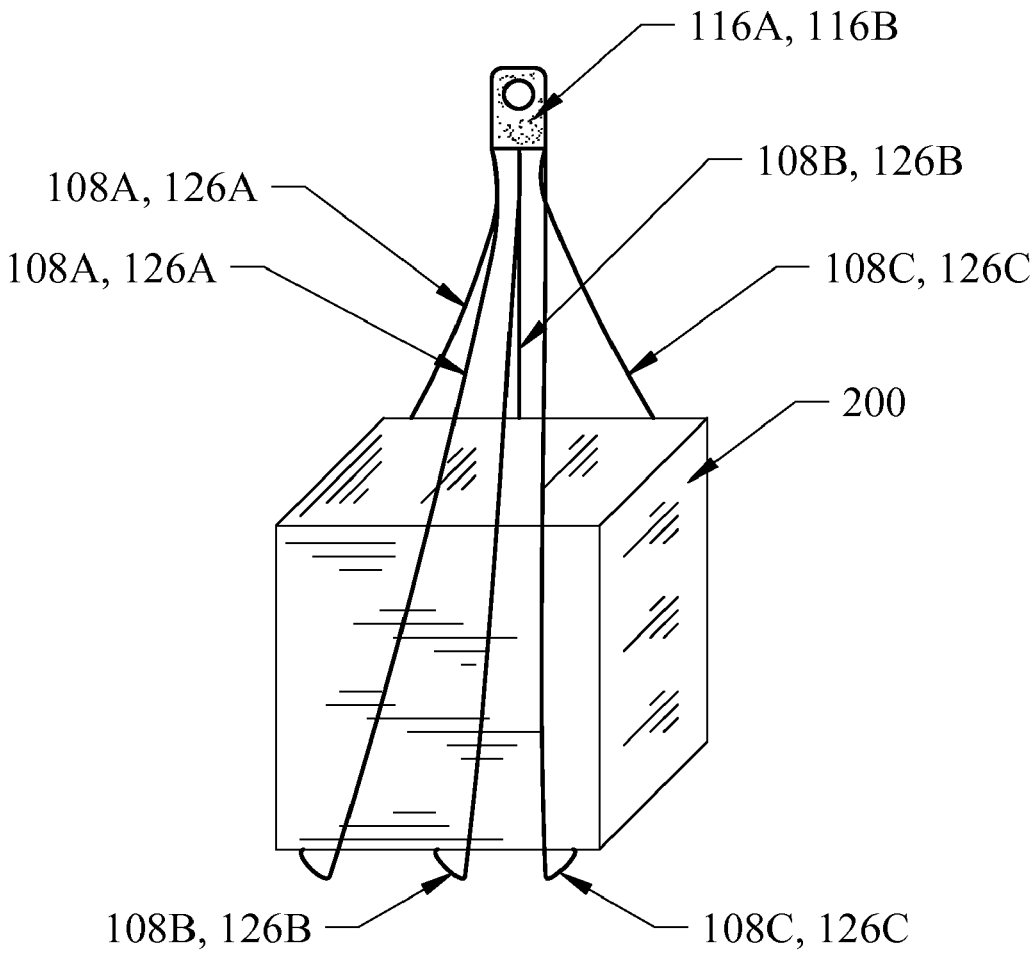
FIG. 3C there is shown a multi-span lifting sling having separate single cores in mid-span of the lifting sling lifting an object.

Referring to FIG. 3C there is shown a multi-span lifting sling having separate single cores in mid-span of the lifting sling lifting an object. As an example and not a limitation, FIG. 3C illustrates how the multi-span configuration of the lifting sling 108, 126 can be positioned on object 200 to distribute the force during the lift across a larger cross sectional area of the lifted object 200. In this regard, forces on the lifted object 200 resultant from its own weight pushing down on the lifting sling are distributed over a larger surface area. The distribution of forces across a larger surface area can prevent the object 200 from being damaged or crushed during the lift. Object 200 can also be referred to as cargo 200.

Figure 3D:
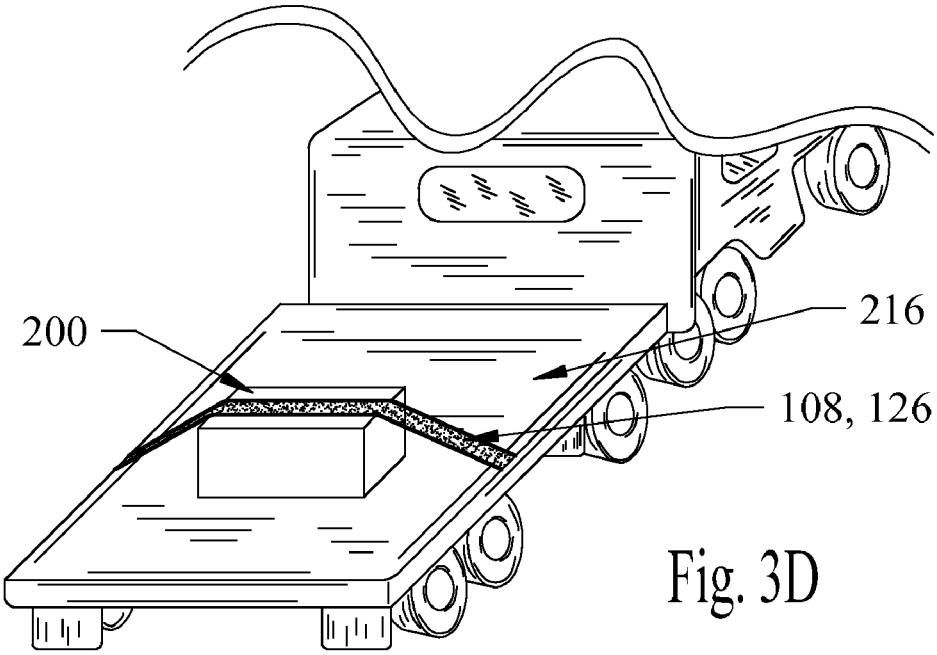
FIG. 3D there is shown a lifting sling 108, 126 adapted for cargo 200 security on a vehicle.

Referring to FIG. 3D there is shown an object 200, also referred to as cargo 200 secured to a vehicle 216. Other vehicles can include, for example and not limitation, ships, trains, planes, and or other similar, suitable, required, and or desired vehicles. In this regard, cargo 200 can be secured for transport on a vehicle 216 by lifting sling 108,126. Once secured, the cargo 200 by way of lifting sling 108, 126 can be monitored for breech conditions. In general, the lifting sling 108, 126 can secure virtually any type or kind of cargo 200, and cargo 200 can be virtually any type or kind of cargo.

Such breech conditions can include, for example and not limitation, out of range lifting sling 108, 126 tension changes, operational parameter out of range conditions, damage to the lifting sling 108, 126, damage to the lifting sling 108, 126 safety core, removal of the lifting sling 108, 126 from the cargo 200, exposure of the lifting sling 108, 126 to potentially damaging conditions, global positioning system (GPS) data change outside certain geographic boundary limits, and or other similar, suitable, required, and or desired breech conditions. Operational parameters can include, for example and not limitation, temperature, pressure, tension, force, optical transmissions, electrical transmissions, chemical, volume, conductivity, and or other similar, suitable, required, and or desired operational parameters.

In response to certain breech conditions certain actions in response can be effectuated. In this regard, such actions can include, for example and not limitation, a control system 500 associated with the lifting sling 108, 126 data communicating with a global network data processing resource, data communicating with other data communicating devices, data logging, allowing the lifting sling 108, 126 to be removed upon reaching a GPS location or other suitable destination, auto releasing the lifting sling 108, 126 upon reaching a GPS location or other suitable destination, providing a plurality of visual indication indicia, providing a plurality of audible indications, and or other similar, suitable, required, and or desired actions. A control system 500 can also be referred to as an electronic system 500, and or an indicator 132.

Such other data communicating devices can include, for example and not limitation, a personal computer 208, a data processing resource, a PDA, a global network based data processing resource, a server, a client device, a wireless phone, a wireless device, other control system 500, and or other similar, suitable, required, and or desired data communicating devices.

In addition, such data communication, and data communication of operational parameters can include changeable colors on an indicator 132, changeable colors of indicia associated with an indicator 132, changeable indicia associated with an indicator 132, visual indication indicia, audible indicators, and or other similar, suitable, required, and or desired data communications.

Once the cargo 200 is secured by the lifting sling 108, 126, the lifting sling 108, 126 having a control system 500 can begin monitoring. The control system 500 monitoring certain operational conditions of the lifting sling can determine if the cargo 200 is secured and or remains secured. In this regard, for example and not limitation, by monitoring the tension, other forces, and or other operational parameters that the lifting sling 108, 126 is exposed to while securing the cargo 200, the control system 500 can determine certain conditions of the cargo 200. In this regard, for example and not limitation, if the tension and or other forces were to vary out of a certain range, a breech condition exists and the security of the cargo 200 may have been compromised.

In another exemplary embodiment if the control system 500 associated with the lifting sling 108, 126 determines that the lifting sling has encountered a breech condition such as excessive environmental conditions, then the control system 500 can determine that the cargo 200 has been exposed to the same excessive environmental conditions.

In a plurality of other exemplary embodiments control system 500 can monitor for and determine if a plurality of other breech conditions have occurred. In response to a plurality of breech conditions, a plurality of actions in response can be effectuated. Such control system 500 monitoring and or actions in response can include, for example and not limitation, data acquisition, data processing, and or data communication of a plurality of data, which can include a plurality of operational parameters related to the lifting sling 108, 126, environmental, and or other similar, suitable, required, and or desired conditions and or parameters.

Such control system 500 data communication can include, for example and not limitation global positioning system (GPS) data, data related to lifting sling 108, 126 operational parameters, data acquired by way of or related to the measurement and dynamics interface 512, data acquired by way of or related to a plurality of safety core 130, data related to the electronic system 500, system 500 configuration data, cargo 200 related configuration data, cargo 200 related parameters and or data, a plurality of breech conditions, a plurality of action in response to a plurality of breech conditions, an electronic mail message, a data file, and or other similar, suitable, required, and or desired data communications. The control system 500 can also be referred to as an electronic system 500, and or an indicator 132.

Figure 3E:
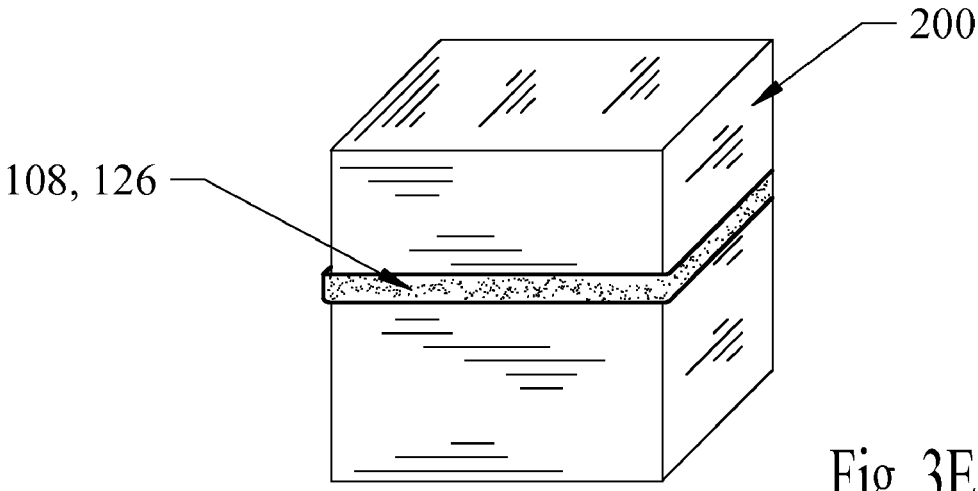
FIG. 3E there is shown a lifting sling 108, 126 adapted for securing cargo 200.

Referring to FIG. 3E there is shown a lifting sling 108, 126 adapted for securing cargo 200. In this embodiment a lifting sling 108, 126 can be utilized to secure the cargo 200 in a manner that prevents tampering with the cargo 200. While the cargo 200 is stored and transported, the lifting sling 108, 126 secures and accompanies the cargo 200. In this regard a control system 500 associated with the lifting sling 108, 126 can monitor certain operational parameters and or other conditions of the lifting sling 108, 126 and of the cargo 200. Furthermore, the control 500 can monitor cargo 200 for certain breech conditions and in response to detected breech conditions effectuated certain action in response.

Figure 3F:
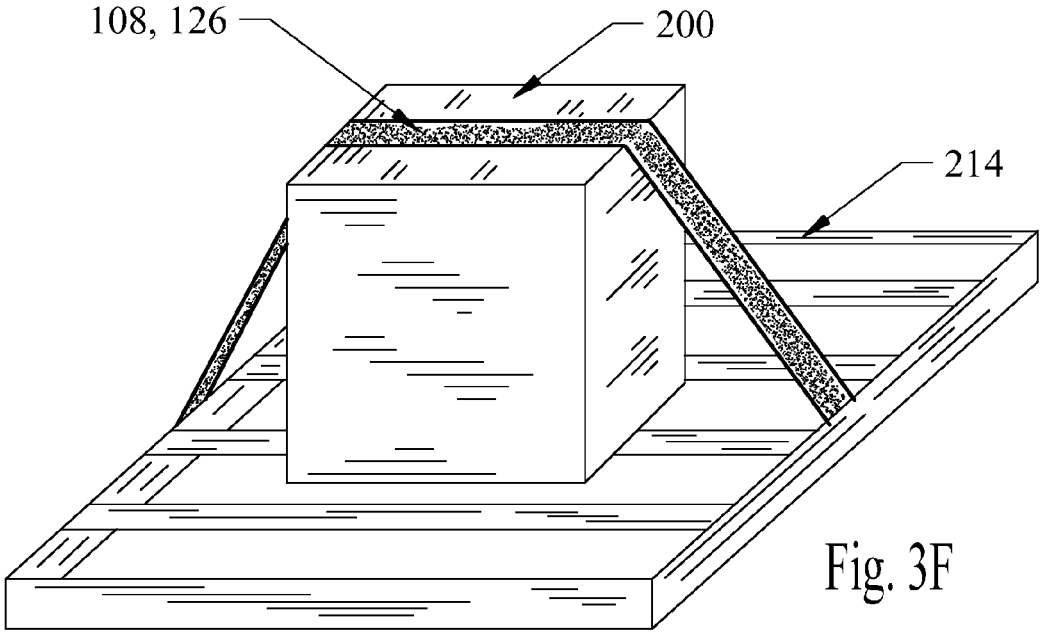
FIG. 3F there is shown a lifting sling 108, 126 adapted for securing cargo 200 on a pallet.

Referring to FIG. 3F there is shown a lifting sling 108, 126 adapted for securing cargo on a pallet 214. In an exemplary embodiment a lifting sling 108, 126 can be utilized to secure cargo 200 to a pallet 214. In this regard, a control system 500 associated with the lifting sling 108, 126 can monitor certain operational parameters and or other conditions of the lifting sling 108, 126 and of the cargo 200. Furthermore the control 500 can monitor cargo 200 for certain breech conditions and in response to detected breech conditions effectuated certain action in response.

Figure 4A:
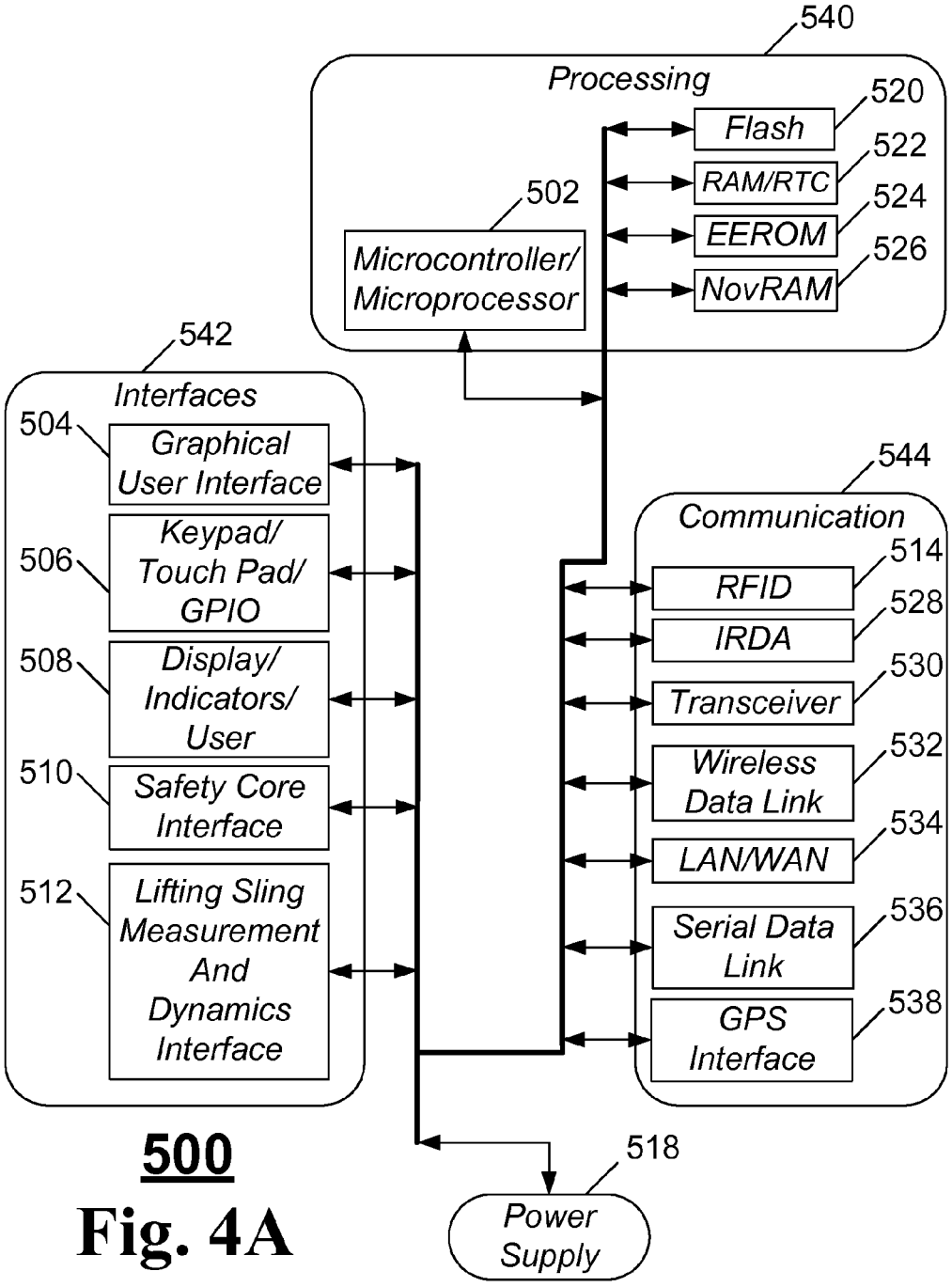
FIGS. 4A-4C there is shown an electronic system 500.

Referring to FIG. 4A there is shown a system block diagram of the electronic system 500 also referred to as electronic system 500, electronic control 500, electronic control system 500, or as a system 500. In an exemplary embodiment, an electronic system 500 can be incorporated into a lifting sling 108, or multi-core lifting sling 126. In such an embodiment the electronic system 500 can activate, monitor, indicate status, provide computational results, store results, data process locally or remotely wired or wirelessly, and or provide other data processing, monitoring, controlling, and or indicating capabilities.

The electronic system 500 can include a processing section 540, an interface section 542, and or communication section/devices 544. A power supply 518 can include alternating current (AC), direct current (DC), batteries, chemical, solar cells, and or other similar or suitable power supplies as may be required or desired in the embodiment.

Interconnected with a microcontroller 502 can be flash memory 520, random access memory (RAM) and or optionally a real time clock (RTC) 522, electrically erasable read only memory (EEROM) 524, and or non-volatile random access memory (NOVRAM) 526.

In addition, a graphical user input interface 504 can be interconnected with a microcontroller 502. The graphical user interface 504 can allow a user to view, change, program, and or otherwise interact with the electronic system 500. In an exemplary embodiment microcontroller 502 can be an INTEL X-scale, strong arm, PENTIUM, x86, MICROCHIP, AMD, ZILOG, MOTOROLA POWERPC, 68 HC, ARM, HITACHI, RABBIT, SANYO, and or other similar, or suitable microcontroller. A microprocessor can be referred to as a microcontroller, and or microcontroller 502. Microcontroller 502 can also incorporate memory. Such memory can include read only memory (ROM), random access memory (RAM), real time clock (RTC), flash memory, Serial I2C flash memory, and or other types, kinds, similar, and or suitable memory.

Furthermore, an electronic system 500 can operate on an embedded binary input-output system (BIOS) including a personal computer (PC) BIOS and can run embedded system operating systems. Embedded system operating systems (OS) can include OSEK, OSEK/VDX, PALM OS, LINUX, WINDOWS 9×, WIND RIVER, WINDOWS 2000, WINDOWS CE, WINDOWS CE.NET, XP, NT, embedded NT, MIRA, QNX NEUTRINO, and other embedded system operating systems. In addition, development tools and application software can include MICROSOFT VISUAL STUDIO development tools, assemblers, C language compilers, cross-assemblers, VIRTUAL JAVA MACHINE (JVM) development tools and application software, and other development tools and application software.

Interconnected with microcontroller 502 can be a keypad/touch pad/general purpose input output (GPIO) 506. A keypad/touch pad/general purpose input output (GPIO) 506 can include push buttons, switches, momentary push buttons, digital inputs and outputs, analog inputs and outputs, and timers to govern the activation, control, monitoring, and or indications of certain conditions or statuses of the lifting sling 108, 126 and or electronic system 500.

Interconnected with microcontroller 502 can be a display/indicator interface/user input 508. A display/indicator/user input interface 508 can include a plurality of user displays and indicators. Such display/indicator interface/user input 508 can include a variety of user feedback devices. Such user feedback devices can include liquid crystal display (LCD), light emitting diodes (LED), organic light emitting diodes (OLED), polymer light emitting electrochemical cells (LECs), pushbuttons, keypads, touch screens, general purpose input/output (GPIO), and or other similar, suitable, required, and or desired user display/indicator/user input interface devices.

Interconnected with microcontroller 502 can be a safety core interface 510. A safety core interface 510 can be interconnected with a plurality of safety cores 130. In this regard, the safety core interface 510 can implement the required and or desired control and monitoring necessary to determine certain characteristics and or operational parameters related to the safety core 130. In this regard, the safety core interface 510 can make certain determinations as to the operation conditions and or suitability for use of the lifting sling 108, 126.

Interconnected with microcontroller 502 can be a lifting sling measurement and dynamics interface 512. The lifting sling measurement and dynamics device 512 can be used to determine certain characteristics and make certain measurements as to the forces and other dynamics the lifting sling is encountering and or has encountered. In this regard, certain operational parameters such as total load weight lifted, number of loads lifted, and other desired and or required measurement and dynamics can be determined, measured, recorded, and or calculated.

Also interconnected with a microcontroller 502 can be a plurality of data communication interfaces. Such plurality of data communication interfaces can include a radio frequency identification device (RFID) 514, infrared (IRDA) interface 528, a transceiver 530, a wireless data link 532, a local area network interface (LAN)/wide area network (WAN) interface 534, a serial data link 536, and or a global position system (GPS) interface 538. The local area network interface (LAN)/wide area network (WAN) interface 534 can include wireless LAN and WAN implementations.

A plurality of antennas can be interconnected with the plurality of wireless devices associated with the plurality of communication devices 544. In an exemplary embodiment any antenna associated with the various wireless devices associate with system 500 can be positioned in proximity to the lifting sling 108, 126 core materials 102. Furthermore, optionally the antenna can be molded or bonded into the lifting sling 108, 128 by coating 110. In this regard, the antenna can be better protected, and out of sight.

The plurality of data communication interface (514, 528, 530, 532, 534, 536, and 538) can include a plurality of devices and interfaces to effect data communication with other data communicating and or data processing resources. Such devices and interfaces can include wired and wireless wide area networking (WAN) and local area networking (LAN) data communications and interfaces. Such WAN and LAN data communications can be by way of proprietary wireless standards and protocols, Institute of Electronics Engineers (IEEE) wireless protocols and standards, ETHERNET, FIREWIRE, 3COM devices, wireless standards and protocols, MOTIENT DATATAC networks, VERIZON networks, CINGULAR networks, SPRINT networks, AT&T networks, SIERRA WIRELESS devices, a WISMO device, wireless standards, and protocols wireless application protocol (WAP), CDPD, PCS, WCDMA, TDMA, TDD, GSM, 1XRTT, CDMA, CDMA 2000, 1X 3G, general packet radio service (GPRS), enhanced data rates for global evolution (EDGE), TDMA, 2G/2.5G type communication ('G' is an abbreviation for generation—for example, 2G is second generation technologies), 3G and 4G type communication, infrared data communication (IRDA), IEEE 802.11'x' ('x' meaning all types and kinds of 802.11 standards and protocols including 'a', 'b', and 'g'), WI-FI, INTEL PRO/WIRELESS 5000 LAN, BLUE TOOTH compliant standards and protocols, small device microwave, spread spectrum, 2.4 GHZ, 5 GHZ, 900 MHZ, 433 MHZ, a single frequency transceiver, a dual frequency transceiver, Internet service provider (ISP), a TCP/IP connection, a PPP, SLIP, or SOCKET layer connection, a RAS connection, by utilizing wireless Internet standards or protocols, or other Internet connection points or connection types or other suitable wireless standards, frequencies, or protocols. Other wired data communications can include serial, TTL, RS232, RS422, and RS485 communications as well as universal serial bus (USB) and or other similar or suitable types and kinds of data communication interfaces.

Data communication between the system 500 in a wired and or wireless manner can be effectuated with other data processing devices such as personal computer (PC) 208, personal data assistant (PDA) 204 also referred to as a PALM device or POCKET PC, a wireless phone 206, data processing device 202, a global network based data processing resource 210, and or other microprocessor based systems and can enable data to be exchanged between the system 500 and or local or remote data processing resources. Such data communications can include software applications to be run by the electronic system 500, data processing tasks that can improve electronic system 500, and or lifting sling 108, 126 operation and or functionality, external data processing device operations and or functionality, and or other similar, suitable, desired, and or required data processing activities.

When an electronic system 500 is embodied as part of a lifting sling 108, or multi-core lifting sling 126 data processing tasks can include and not be limited to monitoring, determining certain conditions or statuses, and indicating certain conditions or statuses, and or other desired and or required data processing tasks.

In a plurality of different embodiments, the system 500 can be tailored to include or exclude certain features. In this regard, for example and not a limitation, if a transceiver 530 is not required for a particular embodiment then the system 500 can be manufactured without the transceiver 530 feature.

Figure 4B:
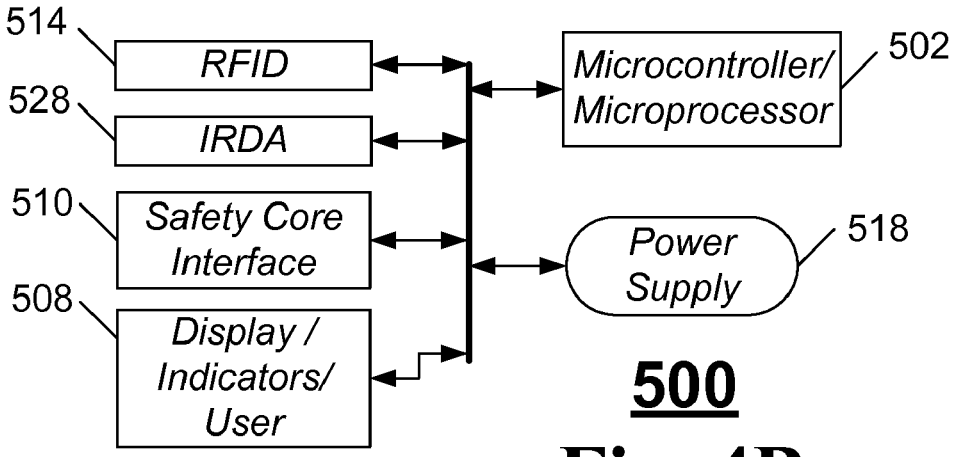
Figure 4C:
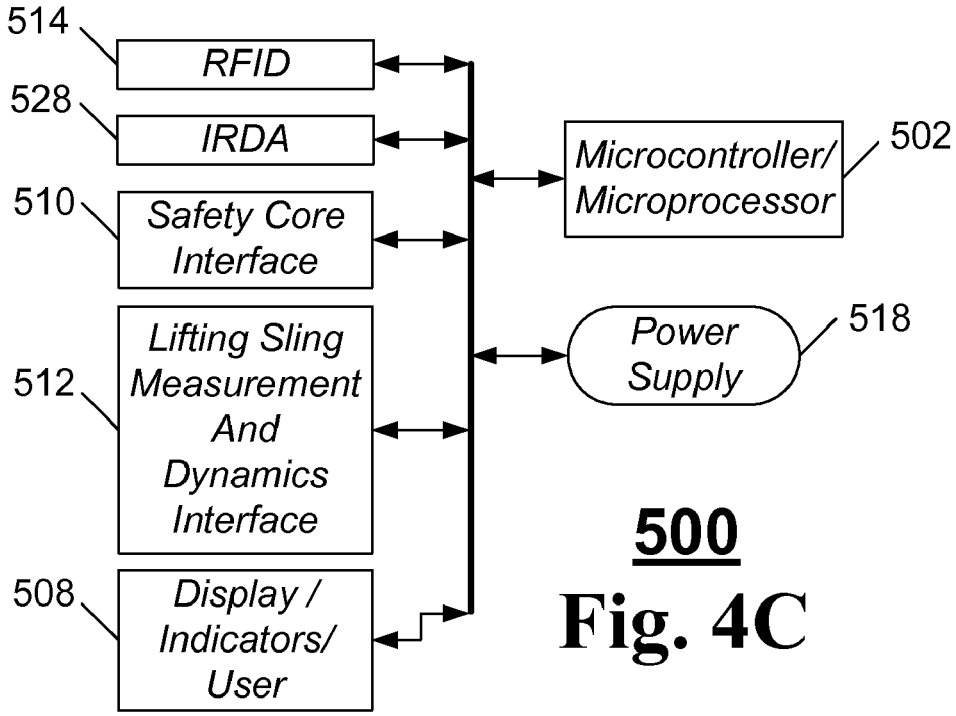

Referring to FIGS. 4B, and 4C there is shown two exemplary embodiments of the electronic system 500 having less than all the features of the embodiment shown in FIG. 4A. In the first exemplary embodiment shown in FIG. 4B the electronic system has be optimized for cost and focuses on a minimal subset of features to implement a system 500. Referring to FIG. 4B there is shown a system 500 having a power supply 518, and a microcontroller 502 interconnected with an RFID 514, an IRDA 528, a safety core interface 510, and a display/indicators/user interface 508.

In a second exemplary embodiment shown in FIG. 4C the system 500 has an expanded subset of features, as related to FIG. 4B, that includes a lifting sling measurement and dynamics interface 512.

Figure 5:
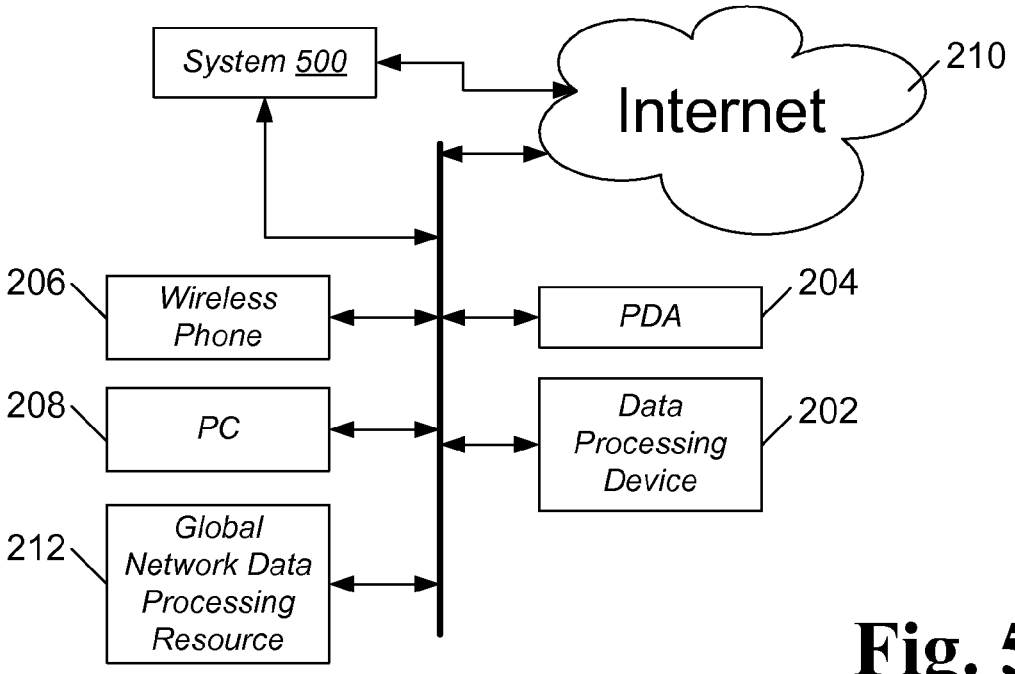
FIG. 5 there is shown an electronic system 500 network that illustrates electronic system 500 data communication with a plurality of data communicating devices, and an electronic system 500 data communicating over a global network to remote global network based data processing resources.
Figure 6:
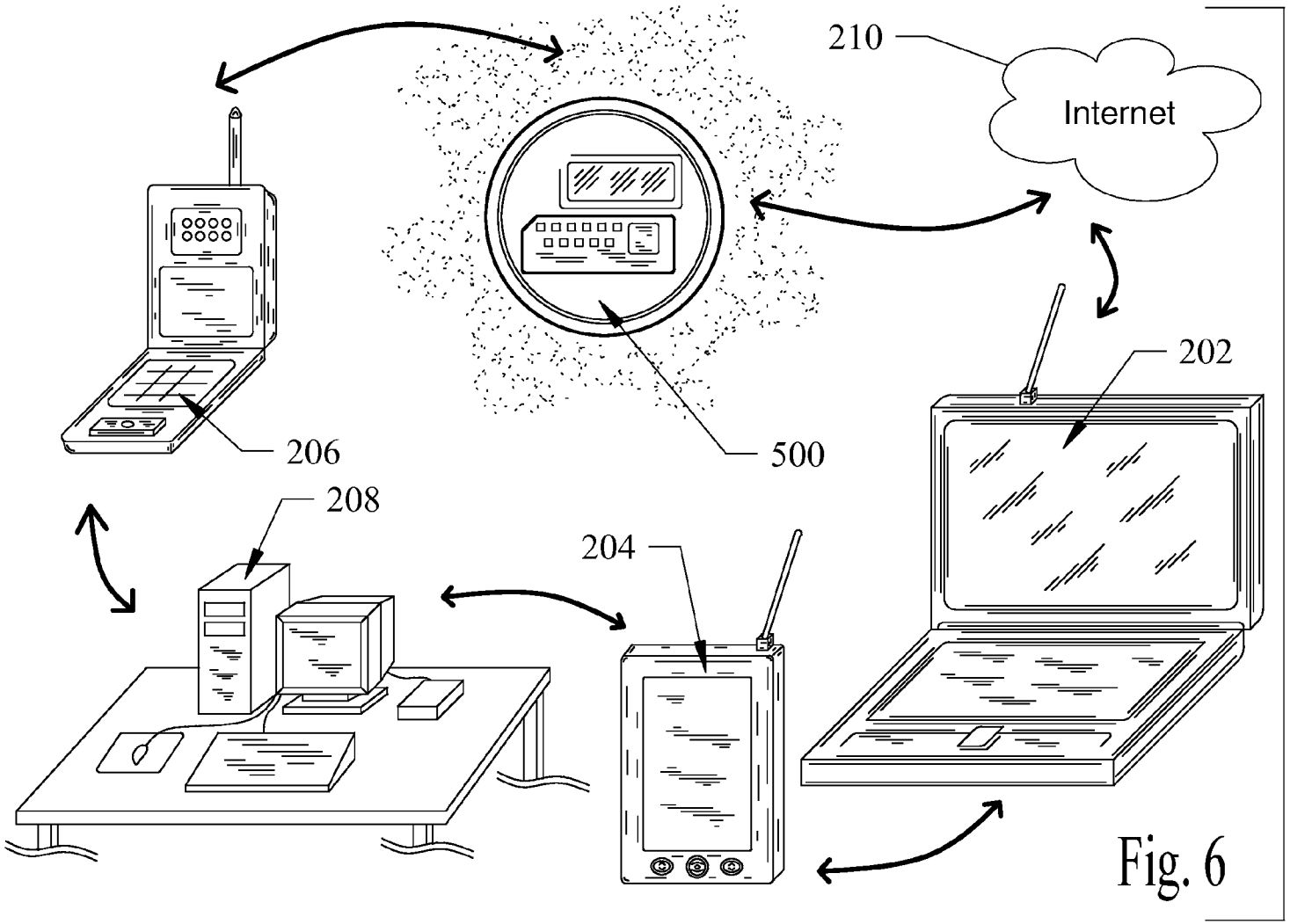
FIG. 6 there is shown a plurality of data communicating devices effectuating data communication between a plurality of data communicating devices and or over a global network.

Referring to FIGS. 5 and 6 there is illustrated the data connectivity between data processing devices, the lifting sling 108, 126 having an electronic system 500, and or a global network. FIG. 5 illustrates electronic system 500 data communication with a plurality of data communicating devices, and an electronic system 500 data communicating over a global network to remote global network based data processing resources. In an exemplary embodiment, electronic system 500 can data communicate directly with data processing devices such as wireless phone 206, PC 208, a global network data processing resource having data communication access over a global network 210 can also be referred to as the Internet 210, PDA 204, and or data processing device 202. FIG. 6 shows a plurality of data communicating devices effectuating data communication between the plurality of data communicating devices and or over a global network.

In another exemplary embodiment the electronic system 500 can data communicate indirectly via a LAN or WAN data communication connection, including data communication over a global network. The Internet can be referred to as a global network. As such, the electronic system 500 can data communicate over a WAN data connection, including over Internet 210, to data communicating devices such as wireless phone 206, (personal computer) PC 208, a global network data processing resource 210, personal data assistant (PDA) 204, data processing device 202, and or to a plurality of other data communicating devices. A laptop computer, desktop computer, network computer, and or notebook computer, can be referred to as a PC 208. A personal computer can be any x86 based system, PENTIUM based, ATHELON based, MOTOROLA based, DELL, GATEWAY, IBM, COMPAQ, HP, APPLE, WINDOWS BASED, and or other similar or suitable computing devices.

Figure 7:
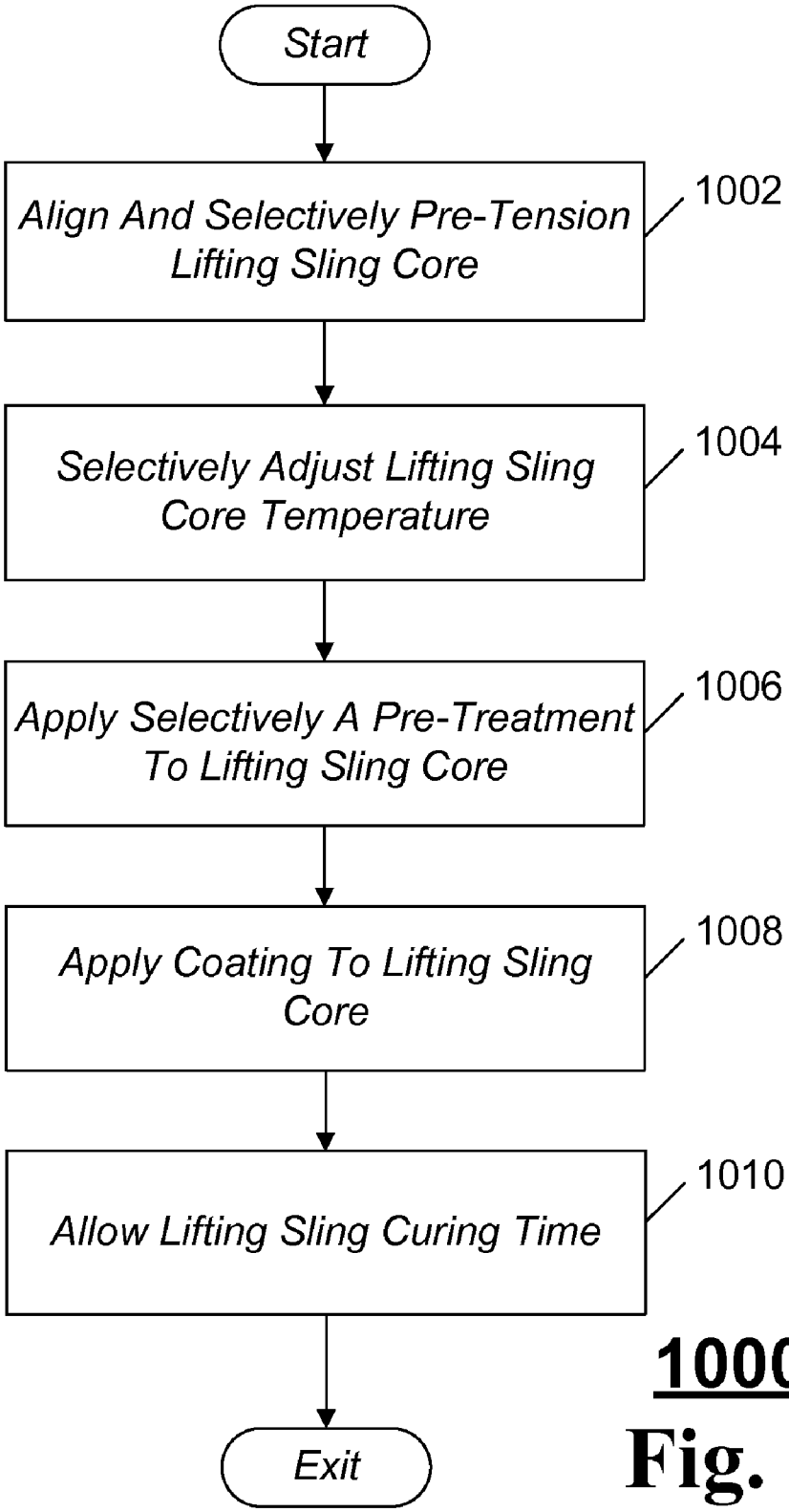
FIG. 7 there is shown a method of coating a lifting sling with polyurea elastomer, polyurethane, or hybrid polyurethane-polyurea elastomer routine 1000.

Referring to FIG. 7 there is shown a method of coating a lifting sling with polyurea elastomer, polyurethane, or hybrid polyurethane-polyurea elastomer routine 1000. In an exemplary embodiment, the lifting sling core 102 needs to be positioned such that the coating can be sprayed on the desired surfaces of the lifting sling core 102. Referring to routine 1000, the method of coating a lifting sling begins with step 1002.

In block 1002 the lifting sling 108, 126 is aligned and selectively pre-tensioned in preparation of coating. Processing then moves to block 1004.

In block 1004 selectively the temperature of the lifting sling core materials 102 can be adjusted. In this regard, regulating the temperature of lifting sling core materials 102, and or lifting sling 108, 126 prior to coating can result in a more even, consistent, and robust coating maximizing bond strength and integrity of the final product. Processing then moves to block 1006.

In block 1006, prior to coating, selectively a pre-treatment can be applied to the lifting sling core materials 102. In this regard, the lifting sling core materials 102 can be prepared with the pre-treatment such as a cleaner or other agent that can facilitate and or enhance the coating process. Processing then moves to block 1008.

In a plurality of exemplary embodiments the steps of pre-tensioning, regulating the temperature of the lifting sling core materials, and applying a pre-treatment to the lifting sling core materials may optionally be implemented in part or in whole as may be required and or desired to achieve the intended results in a particularly manufacturing embodiment. In addition, the steps of pre-tensioning, regulating the temperature of the lifting sling core materials, and applying a pre-treatment to the lifting sling core materials can be referred to as preparing the lifting sling core materials for coating.

In block 1008 the polyurea elastomer, polyurethane, or the hybrid polyurethane-polyurea elastomer coating is applied to the lifting sling core materials 102. Optionally, additional coats of the elastomer can be applied. The thickness may vary across the lifting sling in a random manner or according to a predetermined pattern (for example thicker in certain portion of the lifting sling).

In an exemplary embodiment the spray device 134 can be a multi-reservoir system. In this regard, the components of the coating can be stored separately (isocyanate, amine, and optionally additives can be stored in separate chambers or compartments), and then under spray pressure can be mixed as the coating is applied to the core materials 102. Low and high air pressure spray systems can be utilized as may be required and or desired to obtain the desired coating finish. In addition, optionally a final splatter coat can be applied to add a rugged texture to the lifting coating. Processing then moves to block 1010.

In block 1010 the lifting sling 108, 126 is allowed ample curing time. After such curing time the lifting sling is ready for use. The method is then exited.

Figure 8:
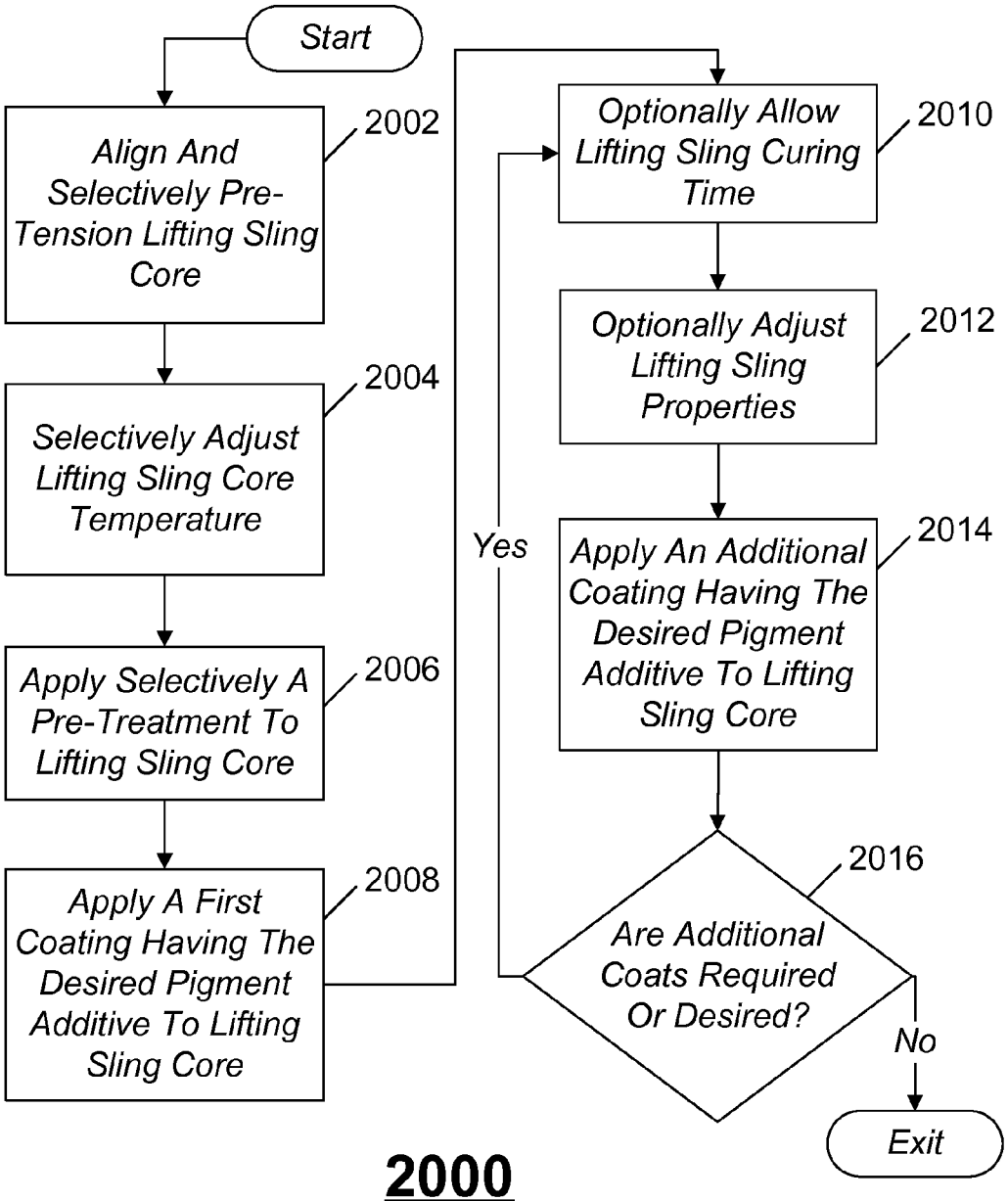
FIG. 8 there is shown a method of coating, with at least two coats of differing pigment colors, a lifting sling with polyurea elastomer, polyurethane, or hybrid polyurethane-polyurea elastomer routine 2000.

Referring to FIG. 8 there is shown a method of coating, with at least two coats of differing pigment colors, a lifting sling 108, 126 with polyurea elastomer, polyurethane, or hybrid polyurethane-polyurea elastomer routine 2000. In an exemplary embodiment, a first color can be applied to the lifting sling core materials 102. Additional coats can then be applied over the top of the first coat and allowed to cure.

During operation of the lifting sling should a cut through the exterior of the additional coats occur the first or interior coat may become exposed. As such, a visual inspection of the lifting sling 108, 126 would reveal a color or pigment variation since the first coat has a different pigment color than the additional coats.

In an exemplary embodiment as a safety measure, if during inspection such a color variation is detected the integrity of the lifting sling 108, 126 has been compromised and the lifting sling 108, 126 should be repaired, or removed from service. Routine 2000 illustrates how such a multiple coating method can be effectuated. Routine 2000 begins in block 2002.

In block 2002 the lifting sling core materials 102 are aligned and selectively pre-tensioned in preparation of coating. Processing then moves to block 2004.

In block 2004 selectively the temperature of the lifting sling core materials 102 can be adjusted. In this regard, regulating the temperature of the lifting sling core materials 102 prior to coating can result in a more even, consistent, and robust coating that maximizes bond strength and integrity of the final product. Processing then moves to block 2006.

In block 2006, prior to coating, selectively a pre-treatment can be applied to the lifting sling core materials 102. In this regard, the lifting sling core materials can be prepared with the pre-treatment such as a cleaner or other agent that can facilitate and or enhance the coating process. Processing then moves to block 2008.

In a plurality of exemplary embodiments the steps of pre-tensioning, regulating the temperature of the lifting sling core materials, and applying a pre-treatment to the lifting sling core materials may optionally be implemented in part or in whole as may be required and or desired to achieve the intended results in a particularly manufacturing embodiment. In addition, the steps of pre-tensioning, regulating the temperature of the lifting sling core materials, and applying a pre-treatment to the lifting sling core materials can be referred to as preparing the lifting sling core materials for coating.

In block 2008 the first coat having a first pigment color of polyurea elastomer, polyurethane, or hybrid polyurethane-polyurea elastomer coating is applied to the lifting sling core materials 102. The thickness may vary across the lifting sling in a random manner or according to a predetermined pattern (for example thicker in certain portion of the lifting sling).

In an exemplary embodiment the spray device 134 can be a multi-reservoir system. In this regard, the components of the coating can be stored separately (isocyanate, amine, and optionally additives can be stored in separate chambers or compartments), and then under spray pressure can be mixed as the coating is applied to the core materials 102. Low and high air pressure spray systems can be utilized as may be required and or desired to obtain the desired coating finish. In addition, optionally a final splatter coat can be applied to add a rugged texture to the lifting coating. Processing then moves to block 2010.

In block 2010 the lifting sling 108, 126 is allowed ample curing time. Processing then moves to block 2012.

In block 2012 optionally properties of the coated lifting sling core materials 102 can be adjusted. In this regard, lifting sling temperatures, the environmental conditions, and or other properties can be selectively adjusted in preparation of an additional coat of the polyurea elastomer, polyurethane, or hybrid polyurethane-polyurea elastomer coating. Processing then moves to block 2014.

In block 2014 an additional coat having a different pigment color of polyurea elastomer, polyurethane, or hybrid polyurethane-polyurea elastomer coating is applied to the lifting sling core materials 102. The thickness may vary across the lifting sling in a random manner or according to a predetermined pattern (for example thicker in certain portion of the lifting sling). Processing then moves to decision block 2016.

In decision block 2016 a determination is made as to whether an additional coat of polyurea elastomer, polyurethane, or hybrid polyurethane-polyurea elastomer is required or desired. If the resultant is in the affirmative that is an additional coat of the elastomer coating is required processing then moves back to block 2010. If the resultant is in the negative that is no additional coating of the elastomer coating is required or desired then the method is exited.

Figure 9:
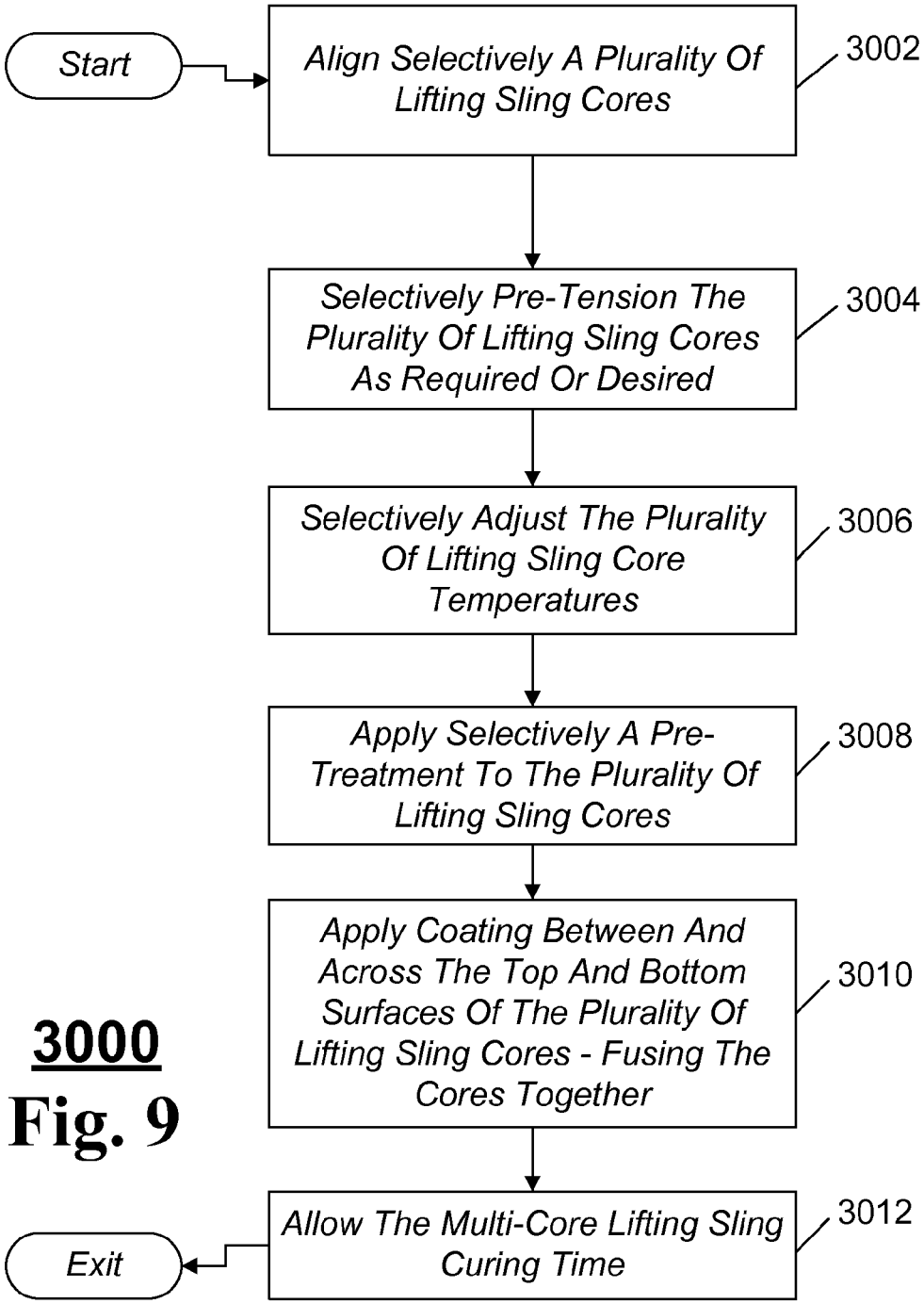
FIG. 9 there is shown a method of manufacturing a multi-core lifting sling routine 3000.

Referring to FIG. 9 there is shown a method of manufacturing a multi-core lifting sling 126 routine 3000. In an exemplary embodiment a multi-core lifting sling 126 can be manufactured from a plurality of single core materials 102 and or a plurality of single core lifting slings 108. Illustrated in routine 3000 is a method of manufacturing such a multi-core lifting sling 126. Processing begins in block 3002.

In block 3002 the plurality of lifting sling core materials 102, and or the plurality of lifting slings 108 are aligned. Processing moves to block 3004.

In block 3004 the plurality of lifting sling core materials 102, and or the plurality of lifting slings 108 are selectively pre-tensioned in preparation of coating. Processing then moves to block 3006.

In block 3006 selectively the temperature of the plurality of lifting sling core materials 102 and or the plurality of lifting slings 108 can be adjusted. In this regard, regulating the temperature of the plurality of lifting sling core materials 102, and or the plurality of lifting slings 108 prior to coating can result in a more even, consistent, and robust coating that can maximize the bond strength and integrity of the final product. Processing then moves to block 3008.

In block 3008, prior to coating, selectively a pre-treatment can be applied to the plurality of lifting sling core materials 102, and or the plurality of lifting slings 108. In this regard, the plurality of lifting sling core materials 102, and or the plurality of lifting slings 108 can be prepared with the pre-treatment such as a cleaner, or other agents that can facilitate and or enhance the coating process. Processing then moves to block 3010.

In a plurality of exemplary embodiments the steps of pre-tensioning, regulating the temperature of the lifting sling core materials, and applying a pre-treatment to the lifting sling core materials may optionally be implemented in part or in whole as may be required and or desired to achieve the intended results in a particularly manufacturing embodiment. In addition, the steps of pre-tensioning, regulating the temperature of the lifting sling core materials, and applying a pre-treatment to the lifting sling core materials can be referred to as preparing the lifting sling core materials for coating.

In block 3010 the polyurea elastomer, polyurethane, or the hybrid polyurethane-polyurea elastomer coating is applied to the plurality of lifting sling materials 102, and or the plurality of lifting slings 108. In particular, a seaming coat is applied between each of the plurality of lifting sling core materials 102, and or the plurality of lifting slings 108 as a way of tenaciously bonding or fusing the cores together. Optionally, additional coating of the elastomer can be added to the lifting sling materials 102, and or the plurality of lifting slings 108 as may be required and or desired. The thickness may vary across the lifting sling in a random manner or according to a predetermined pattern (for example thicker in certain portion of the lifting sling).

In a plurality of exemplary embodiments the coating process can either be performed only to the end sections of the composite multi-core lifting sling 126, or the coating can be performed over the entire length of the composite multi-core lifting sling 126. Coating of only the end sections of the multi-core lifting sling 126 can result in a multi-span lifting sling. Such multi-span lifting sling types are shown, for example and not limitation, in FIGS. 2G and 2H. Coating the entire length of the composite multi-core lifting sling 126 can result in the lifting sling type shown, for example and not limitation, in FIG. 2F.

In an exemplary embodiment the spray device 134 can be a multi-reservoir system. In this regard, the components of the coating can be stored separately (isocyanate, amine, and optionally additives can be stored in separate chambers or compartments), and then under spray pressure can be mixed as the coating is applied to the core materials 102. Low and high air pressure spray systems can be utilized as may be required and or desired to obtain the desired coating finish. In addition, optionally a final splatter coat can be applied to add a rugged texture to the lifting coating. Processing then moves to block 3012.

In block 3012 the multi-core lifting sling 126 is allowed ample curing time. After such curing time the lifting sling 126 is ready for use. The method is then exited.

Figure 10:
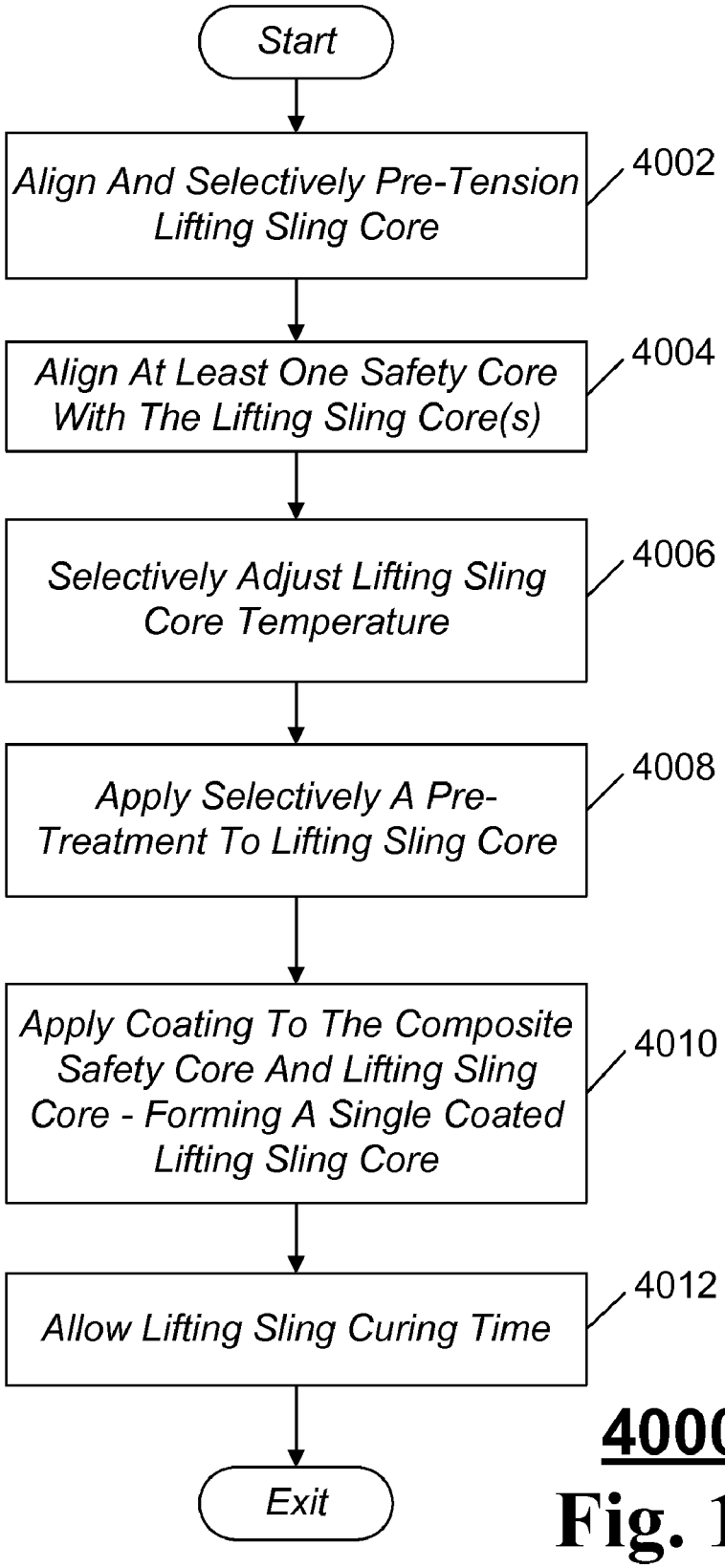
FIG. 10 there is shown a method of manufacturing a lifting sling having a safety core routine 4000.

Referring to FIG. 10 there is shown a method of manufacturing a lifting sling 108, 126 having a safety core 130 routine 4000. In an exemplary embodiment, a safety core 130 can be placed with the lifting string core materials 102 and the combination safety core 130 and lifting sling core materials 102 can be coated, tenaciously bonding the two elements together.

Once the elements are bonded together, monitoring the safety core 130 can give indications of certain operational statuses, and or service conditions of the lifting sling 108, 126. During operation of the lifting sling 108, 126 the safety core 130 will be subjected to the same forces and loads as the lifting sling core materials 102. As such, damages to the lifting sling core materials 102 such a overstretching, crushing, and or other damaging forces will also occur to the safety core 130.

An indicator 132 and or an electronic system 500 can be utilized to monitor the operational status and or service conditions of the safety core 130. In this regard, feedback can be provided by way of indicating means, display interfaces, and or other appropriate methods as to the operational statuses and or service conditions of the lifting sling 108, 126. Processing begins in block 4002.

In block 4002 the lifting sling 108, 126 is aligned and selectively pre-tensioned in preparation of coating. Processing then moves to block 4004.

In block 4004 at least one safety core 130 is aligned with the lifting sling core materials 102. In an exemplary embodiment the safety core 130 can be aligned parallel to and traverse the length of the lifting sling core materials 102. Preferably at least one end of the safety core 130 has either an indicator 132 and or an electronic system 500 attached thereto. Processing then moves to block 4006.

In block 4006 selectively the temperature of the lifting sling core materials 102 can be adjusted. In this regard, regulating the temperature of the lifting sling core materials 102 prior to coating can result in a more even, consistent, and robust coating that can maximize bond strength and integrity of the final product. Processing then moves to block 4008.

In block 4008, prior to coating, selectively a pre-treatment can be applied to the lifting sling core materials 102. In this regard, the lifting sling core materials can be prepared with the pre-treatment such as a cleaner, or other agents that can facilitate and or enhance the coating process. The thickness may vary across the lifting sling in a random manner or according to a predetermined pattern (for example thicker in certain portion of the lifting sling). Processing then moves to block 4010.

In a plurality of exemplary embodiments the steps of pre-tensioning, regulating the temperature of the lifting sling core materials, and applying a pre-treatment to the lifting sling core materials may optionally be implemented in part or in whole as may be required and or desired to achieve the intended results in a particularly manufacturing embodiment. In addition, the steps of pre-tensioning, regulating the temperature of the lifting sling core materials, and applying a pre-treatment to the lifting sling core materials can be referred to as preparing the lifting sling core materials for coating.

In block 4010 the polyurea elastomer, polyurethane, or the hybrid polyurethane-polyurea elastomer coating is applied to the composite safety core 130 and lifting sling core materials 102. Optionally, additional coating of the elastomer can be applied as may be required and or desired.

In an exemplary embodiment the spray device 134 can be a multi-reservoir system. In this regard, the components of the coating can be stored separately (isocyanate, amine, and optionally additives can be stored in separate chambers or compartments), and then under spray pressure can be mixed as the coating is applied to the core materials 102. Low and high air pressure spray systems can be utilized as may be required and or desired to obtain the desired coating finish. In addition, optionally a final splatter coat can be applied to add a rugged texture to the lifting coating. Processing then moves to block 4012.

In block 4012 the lifting sling 108, 126 is allowed ample curing time. The manufacturing method is then exited.

Figure 11:
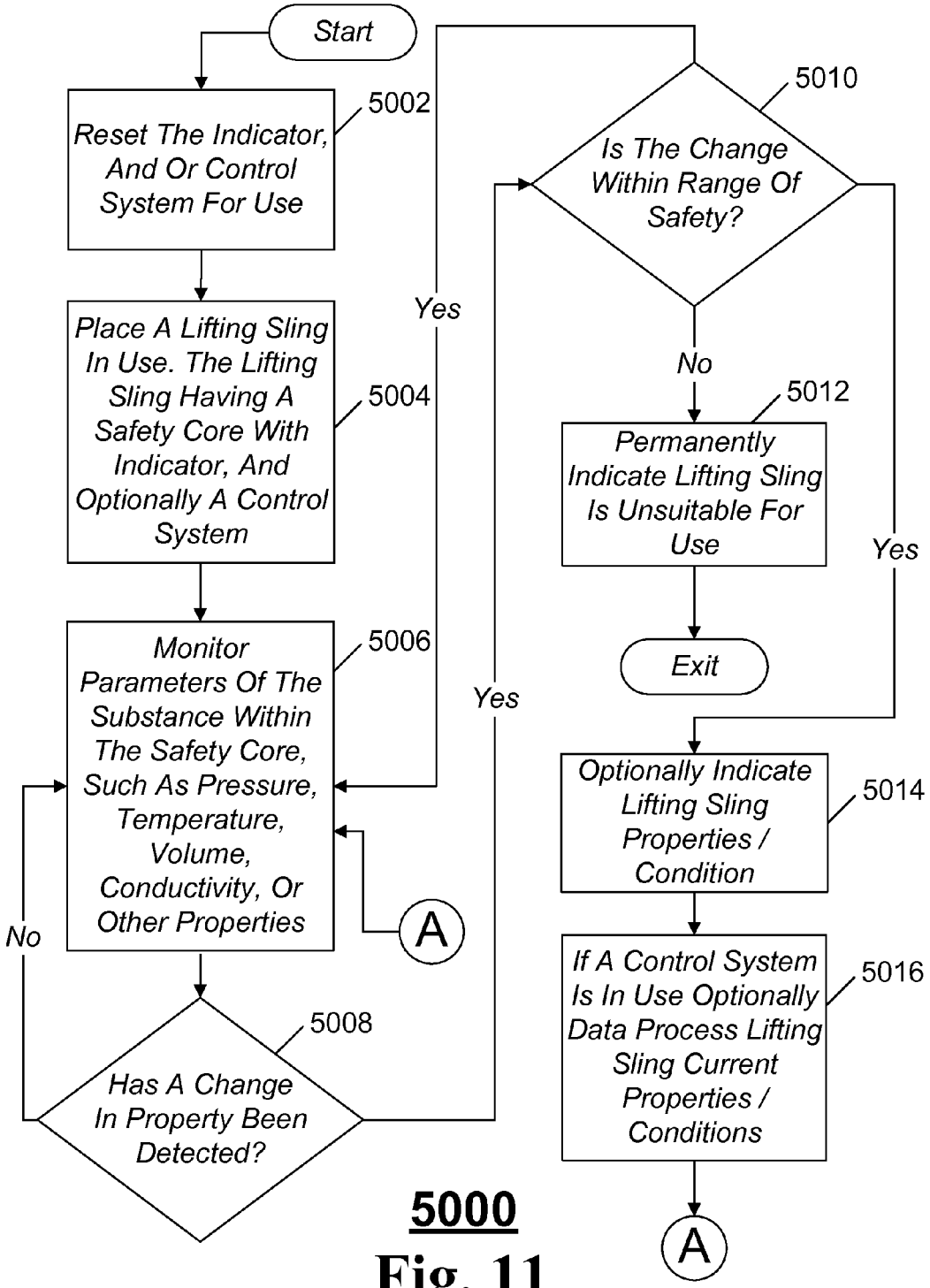
FIG. 11 there is shown a method of rendering a lifting sling unsuitable for use routine 5000.

Referring to FIG. 11 there is shown a method of rendering a lifting sling unsuitable for use routine 5000. In an exemplary embodiment, when a trauma or force is applied to the lifting sling 108, 126 in such a manner that the lifting sling has been damaged the indicator 132 and or electronic system 500 by way of interconnection to the safety core 130 can indicate to a user that the lifting sling is no longer operationally sound, unsuitable for use, and should be removed from service. Processing begins in block 5002.

In block 5002 the indicator 132 and or the electronic system 500 can be reset. In exemplary embodiment, the lifting sling 108, 126 has a safety core 130 interconnected with either an indicator 132 and or electronic system 500. Processing then moves to block 5004.

In block 5004 the lifting sling 108, 126 is placed in service. The lifting sling 108, 126 having a safety core 130, an indicator 132, and or an optional electronic system 500 can be utilized as may be required or desired in the lifting of loads, securing of cargo, and or other similar, suitable, required and or desired activities. Processing then moves to block 5006.

In block 5006 the indicator 132 and or the electronic system 500 monitors the safety core 130, and or operational parameters of the substance within the safety core 130. In this regard, such operational parameters can include, for example and not limitation, temperature, pressure, tension, force, optical transmission, electrical transmission, chemical, volume, and or conductance to name a few.

In an exemplary embodiment where the safety core is an electrical conductor, the conductance of the safety core can be utilized as at least one method of determining the operational condition, and or suitably for use of the lifting sling. Processing then moves to decision block 5008.

In decision block 5008 a determination is made as to whether a change has been detected in the operational parameters and or properties being monitored. If the resultant is in the affirmative that is a change in the operational parameters and or properties has been detected then processing moves to decision block 5010. If the resultant is in the negative that is a change in operational parameters and or properties has not been detected then processing moves back to block 5006.

In decision block 5010 a determination is made as to whether the changes in the operational parameters and or properties are within safety range or limits. If the resultant is in the affirmative that is the change in the operational parameters and or properties are within safety range or limits then processing moves to block 5014. If the resultant is in the negative that is the change in the operational parameters and or properties is not within safety range or limits then processing moves to block 5012.

In block 5012 the indicator 132 and or the electronic system 500 is changed to permanently indicate that the lifting sling is unsuitable for use. In an exemplary embodiment, such permanent indication that the lifting sling is unsuitable for use can be displayed on a user interface, and or communicated to a user in other appropriate means and or methods. The method is then exited.

In block 5014 optionally the indicator 132 and or the electronic system 500 can indicate to a user that certain parameters and or properties have changed. In an exemplary embodiment, such indication of changed operational parameters and or properties can be displayed on a user interface and or communicated to the user in other appropriate means and methods.

In block 5016 if an electronic system 500 is in use optionally data can be processed. In an exemplary embodiment such data can include the lifting slings 108, 126 current operational parameters, properties, and or conditions, as well as other data that may be required and or desired.

In an exemplary embodiment a counter can be utilized to keep track of the number of lifts the lifting sling has lifted. In this regard, upon reached a predetermined count of the number of lifts the lifting sling can indicate it is no longer suitable for use.

In another exemplary embodiment a real time clock (RTC) can be utilized to determine how long the lifting sling has been in use. In this regard, upon reaching a predetermined time of service period the lifting sling can indicate it is no longer suitable for use. Processing then returns to block 5006.

Figure 12:
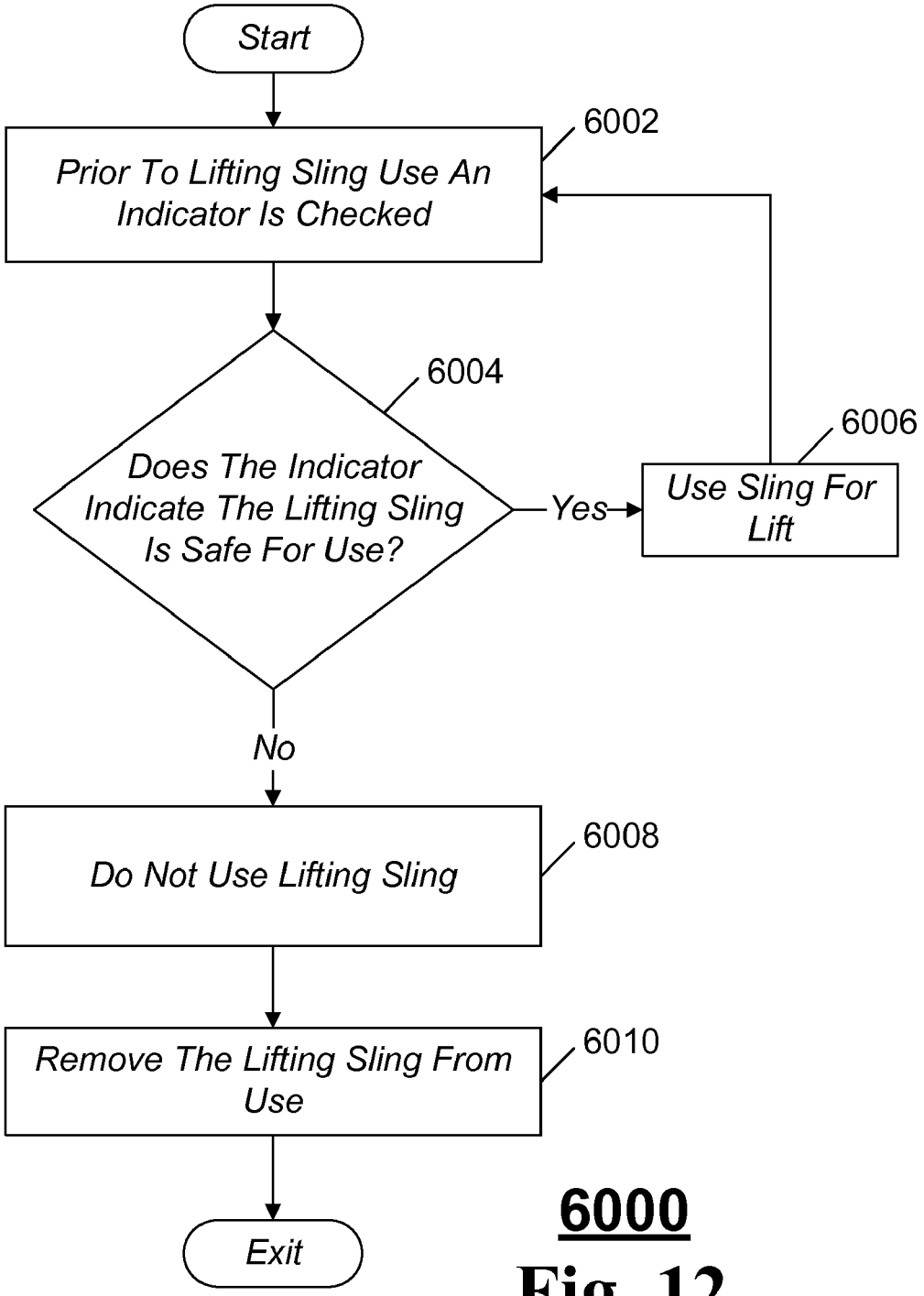
FIG. 12 there is shown a method of determining the operational condition, and or suitability for use of a lifting sling for use by inspection of a safety indicator or electronic system routine 6000.

Referring to FIG. 12 there is shown a method of determining the operational condition, and or suitability for use of a lifting sling by inspection of a safety indicator 132 and or an electronic system 500 routine 6000. In an exemplary embodiment, a user of the lifting sling 108, 126 can inspect an indicator 132 and or electronic system 500 in order to determine if the lifting sling 108, 126 is operationally sound and suitable for use. In this regard, the indicator 132 and or the electronic system 500 can be interconnected to a safety core 130. The indicator 132 and or the electronic system 500 monitors the safety core 130 to make certain determinations as to the operational condition, and or suitability for use of the lifting sling 108, 126 and the lifting sling core materials 102. If the lifting sling 108, 126 and or to lifting sling core materials 102 have been compromised by damaging forces and or other traumas the indicator 132 and or electronic system 500 by way of monitoring the safety core 130 can provide an indication that the lifting sling has been compromised and is not suitable for use. Processing begins in block 6002.

In block 6002 prior to the lifting slings use an indicator 132 and or electronic system 500 is checked or inspected. Processing then moves to decision block 6004.

In decision block 6004 a determination is made as to whether the indicator 132 and or the electronic system 500 indicates that the lifting sling 108, 126 is safe, operationally sound, and or ready for use. If the resultant is in the affirmative that is the indicator 132 and or the electronic system 500 indicates that the lifting sling 108, 126 is safe, operationally sound, and or ready for use then processing returns to block 6002. If the resultant is in the negative that is the indicator 132 and or electronic system 500 indicates that the lifting sling 108, 126 is not safe, not operationally sound, and or not ready for use then processing moves to block 6008.

In block 6008 the user having inspected the lifting sling 108, 126 indicator 132 and or electronic system 500 and found that the lifting sling 108, 126 is not suitable for use, does not use the lifting sling 108, 126. Processing then moves to block 6010.

In block 6010 in an exemplary embodiment the user removes the lifting sling from use. The method is then exited.

Figure 13:
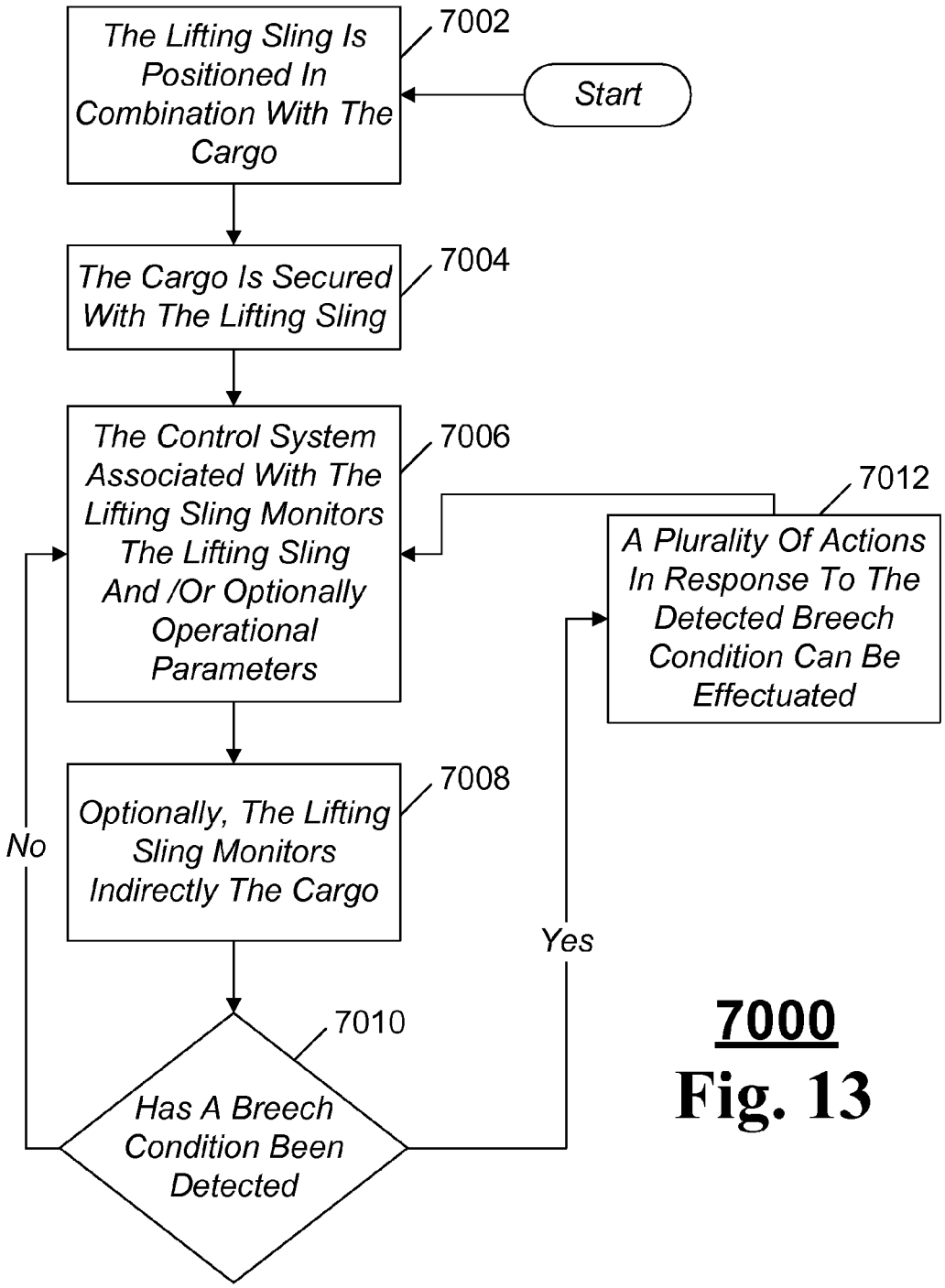
FIG. 13 there is shown a method of using a lifting sling 108, 126 to effectuate cargo 200 security routine 7000.

Referring to FIG. 13 there is shown a method of using a lifting sling 108, 126 to effectuate cargo 200 security routine 7000. In an exemplary embodiment, the lifting sling 108, 126 can be positioned in combination with a plurality of cargo 200. Once positioned, the lifting sling 108, 126 can be utilized to secure the cargo 200. Once secured, a control system 500 associated with the lifting sling 108, 126 can be utilized to monitor certain operational parameters of the lifting sling 108, 126 and or monitor the cargo 200.

In an exemplary embodiment, the control system 500 can be programmed to monitor and detect a plurality of breech conditions. Furthermore, the control system 500 can be programmed to effectuate a plurality of actions in response to the detection of a plurality of breech conditions. In this regard, the lifting sling 108, 126 having an associated control system 500 can be adapted to monitor and secure a plurality of cargo 200. The method begins in block 7002.

In block 7002 the lifting sling 108, 126 is positioned in combination with a plurality of cargo 200. The lifting sling 108, 126 can have associated with it a control system 500. A control system 500 can also be referred to as an electronic system 500, and or an indicator 132. Processing then moves to block 7004.

In block 7004 the cargo 200 is secured by lifting sling 108, 126. Such securing can include, for example and not limitation, securing the cargo 200 such as illustrated in FIGS. 3D, 3E, and 3F, and or securing cargo 200 in a similar, suitable, required, and or desired method and or manner. In general, securing the cargo 200 with a lifting sling 108, 126 can effectuate the control system 500 to begin monitoring for certain breech conditions.

Once the lifting sling 108, 126 is secured in combination with the cargo 200 the operational parameters that vary is response to the lifting sling being in contact with the cargo 200 can be monitored by way of the lifting sling control system 500. As such, variations in certain of the lifting sling 108, 126 operational parameters can be utilized to make certain determination related to the cargo 200 being secured by the lifting sling.

In an exemplary embodiment the control system 500 monitoring certain operational conditions of the lifting sling can determine if the cargo 200 is secured and or remains secured. In this regard, for example and not limitation, by monitoring the tension, other forces, and or operational parameters that the lifting sling 108, 126 is under while securing the cargo 200, the control system 500 can determine certain conditions of the cargo 200. In this regard, for example and not limitation, if the tension and or other forces were to vary out of a certain range a breech condition exists and that security of the cargo 200 may have been compromised.

In another exemplary embodiment if the control system 500 associated with the lifting sling 108, 126 determines that the lifting sling has encountered a breech condition such as excessive environmental conditions, then the control system 500 can determine that the cargo 200 has been exposed to the same excessive environmental conditions. Processing then moves to block 7006.

In block 7006 the control system 500 associated with the lifting sling 108, 126 can monitor for breech conditions certain operational parameters of the lifting sling 108, 126. In addition, the control system 500 can also monitor certain parameters related to the cargo 200. In this regard, by monitoring for breech conditions by way of certain operational parameters, methods of determining the operational condition, suitably for use of the lifting sling, and or determinations of cargo 200 security and or other conditions of the cargo 200, can be effectuated.

Such operational parameters can include, for example and not limitation, temperature, pressure, tension, force, optical transmissions, electrical transmissions, chemical, volume, conductivity, and or other similar, suitable, required, and or desired operational parameters. In this regard, by monitoring certain operational parameters related to the lifting sling 108, 126, and or the cargo 200, methods of determining the operational condition, of the lifting sling 108, 126, and or cargo 200 can be implemented.

With respect to breech conditions, such breech conditions can include, for example and not limitation, out of range lifting sling 108, 126 tension changes, operational parameter out of range conditions, damage to the lifting sling 108, 126, damage to the lifting sling 108, 126 safety core, removal of the lifting sling 108, 126 from the cargo 200, exposure of the lifting sling 108, 126 to potentially damaging conditions, global positioning system (GPS) data change outside certain geographic boundary limits, and or other similar, suitable, required, and or desired breech conditions. Processing then moves to block 7008.

In block 7008 optionally and or selectively, the lifting sling 108, 126 having a control system 500 can monitor the cargo 200 and or areas in proximity to the lifting sling and cargo. In an exemplary embodiment, for example and not limitation, the lifting sling 108, 126 by association with cargo 200 in part including close proximity, tension, forces, and or operational parameters in common, as well as other related and unrelated conditions can effectuate the ability of lifting sling 108, 126 by way of control system 500 the monitoring for and determination of breech conditions, and as appropriate take actions in response. Processing then moves to decision block 7010.

In decision block 7010 a determination is made as to whether a breech condition has been detected. If the resultant is in the affirmative, that is a breech condition has been detected then processing moves to block 7012. If the resultant is in the negative, that is a breech condition has not been detected then processing moves back to block 7006.

In block 7012 a plurality of actions in response to the detected breech conditions can be effectuated. In this regard, such actions can include, for example and not limitation, a control system 500 associated with the lifting sling 108, 126 data communicating with a global network data processing resource, data communicating with other data communicating devices, data logging, allowing the lifting sling 108, 126 to be removed upon reaching a GPS location and or other suitable destination, auto releasing the lifting sling 108, 126 upon reaching a GPS location, providing a plurality of visual indication indicia, providing a plurality of audible indications, and or other similar, suitable, required, and or desired actions.

Such control system 500 data communication can include, for example and not limitation, global positioning system (GPS) data, data related to lifting sling 108, 126 operational parameters, data acquired by way of or related to the measurement and dynamics interface 512, data acquired by way of or related to a plurality of safety core 130, data related to the electronic system 500, system 500 configuration data, cargo 200 related configuration data, cargo 200 related parameters and or data, a plurality of breech conditions, a plurality of action responses to a plurality of breech conditions, an electronic mail message, a data file, and or other similar, suitable, required, and or desired data communications.

Such other data communicating devices can include, for example and not limitation, a personal computer 208, a data processing resource, a PDA, a global network based data processing resource, a server, a client device, a wireless phone, a wireless device, other control system 500, and or other similar, suitable, required, and or desired data communicating devices.

In addition, such data communication, and data communication of operational parameters can include changeable colors on an indicator 132, changeable colors of indicia associated with an indicator 132, changeable indicia associated with an indicator 132, visual indication indicia, audible indicators, and or other similar, suitable, required, and or desired data communications. Processing then returns to block 7006.

Figure 14:
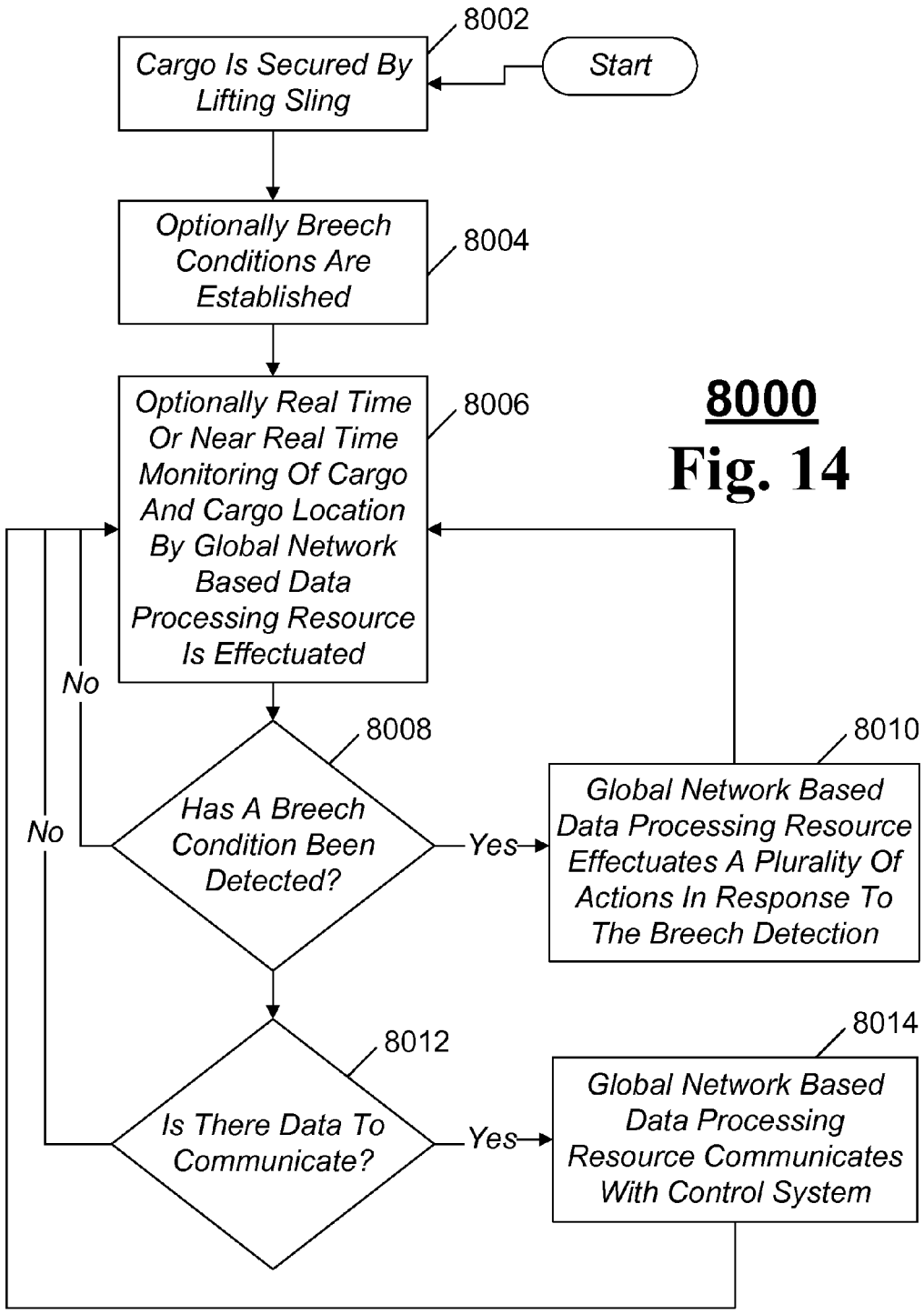
FIG. 14 there is shown a method of utilizing a global network based data processing resource to effectuate cargo 200 management routine 8000.

Referring to FIG. 14 there is shown a method of utilizing a global network based data processing resource to effectuate cargo 200 management routine 8000. In an exemplary embodiment a global network based data processing resource can be utilized to manage and monitor cargo 200 along a route. In addition, the global network based data processing resource can upload/download and or manage cargo 200 breech conditions, perform real time monitoring, effectuate actions in response to breech detections, monitor the cargo 200 along its entire route, issue and effectuate commands such as 'destroy the cargo' in certain conditions, monitor/determine and or report cargo 200 tamper and or security/route history, initiate auto release, and or effectuate other command and control features associated with the lifting sling 108, 126 as may be required and or desired in various conditions/embodiments. A remote network, PC, and or other similar, suitable, required, and or desired data processing device can be referred to as a global network based data processing resource. Processing begins in block 8002.

In block 8002 the cargo 200 is secured by lifting sling 108, 126. Processing then moves to block 8004.

In block 8004 optionally breech condition are established. In this regard, the global network based data processing resource can elect to upload, download, or manage breech conditions at the global network data processing resource. In addition, the global network based data processing resource can upload, download, and or data communicate with the lifting sling 108, 126 control system 500 as may be required, and or desired in a plurality of exemplary embodiments. Processing then moves to block 8006.

In block 8006 optionally the global network based data processing resource can effectuate real time cargo 200 monitoring. In this regard, the control system 500 associated with the lifting sling 108, 126 can data communicate with the global network based data processing resource to effectuate real time or near real time cargo 200 monitoring, management, and or control.

In an exemplary embodiment, for example and not limitation, the global network data processing resource can monitor and report on the travel/route/security history of the cargo 200. In this regard, the global network based data processing resource can data communicate as required and or necessary with the control system 500. The collected data can then be stored in a database or otherwise processed and utilized as required and or desired in various travel/route/security history applications, cargo tampering reports, and or other similar, suitable, required, and or desired cargo reports and or other report/applications.

Furthermore, such data communication between the control system 500 and the global network data processing resource can be utilized to effectuate a network based cargo management information system. In this regard, in addition to cargo reports and other management information system features, cargo can be tracked along its entire route instead of implement cargo tracking at certain checkpoints only.

Tracking cargo 200 along its entire route instead of at checkpoints can offer certain advantages. One such advantage can include providing a more real time granular reporting means whereby more accurate cargo tampering, breech monitoring, cargo location tracking, cargo intercepting, cargo route monitoring, GPS data application, 'destroying cargo' on certain breech detection, auto-release of the lifting sling 108, 126 as may be required, and or other similar, suitable, required, and or desired benefits, advantages, features enabled by a more real time and or near real time granular reporting means. Reporting means can include data communication between the lifting sling 108, 126 control system 500 and a global network based data processing resource. Processing then moves to decision block 8008.

In decision block 8008 a determination is made as to whether the global network based data processing resource has detected a breech condition. If the resultant is in the affirmative that is the global network based data processing resource has detected a breech condition then processing moves to block 8010. If the resultant is in the negative that is the global network based data processing resource has not detected a breech condition then processing returns to block 8006.

In block 8010 the global network based data processing resource effectuates, in response to the breech condition detection, and action in response. Such action in response can include a data communication to the lifting sling 108, 126 control system 500, and or other actions local and or remote from the global network based data processing resource. Processing then moves to decision block 8012.

In decision block 8012 a determination is made as to whether the global network based data processing resource and or the control system 500 has data to communicate. If the resultant is in the affirmative that is the global network based data processing resource and or control system 500 has data to communicate then processing moves to block 8014. If the resultant is in the negative that is the global network based data processing resource and or control system 500 does not have data to communicate then processing returns to block 8006.

In block 8014 the global network based data processing resource and the control system 500 data communicate. As required and or desired such data can be communicated, stored and or otherwise utilized as may be required, and or desired in a plurality of exemplary embodiments. Processing then returns to block 8006.

While this invention has been described with reference to specific embodiments, it is not necessarily limited thereto. Accordingly, the appended claims should be construed to encompass not only those forms and embodiments of the invention specifically described above, but to such other forms and embodiments, as may be devised by those skilled in the art without departing from its true spirit and scope.

What is claimed is:

1. A method of manufacturing single and multi-core lifting slings, the method comprising:

aligning a plurality of core fibers to form a sling body;

bonding a safety core by way of a coating proximate the plurality of core fibers, ends of the safety core are concealed within the coating, the coating comprising at least an isocyanate mixed with an amine forming polyurea;

applying a coating along length of the sling body, wherein an initial layer of the coating seals the plurality of core fibers from exposure to contaminates;

applying additional layers of the coating in areas of the sling body subject to high crush and shear forces; and applying a final splatter layer of the coating applied along the sling body, the final splatter layer creating a rugged non-slip grip exterior surface.

2. The method in accordance with claim 1, further comprising:

tensioning the sling body to normal use load bearing conditions causing the plurality of core fibers to stretch prior to coating.

3. The method in accordance with claim 1, further comprising:

adjusting selectively the temperature of the plurality of core fibers prior to coating.

4. The method in accordance with claim 1, further comprising:

pre-treating, to facilitate or enhance coating, selectively the plurality of core fibers.

5. The method in accordance with claim 1, further comprising:

forming at least one of a second sling body from a second plurality of core fibers; and forming a multi-core lifting sling by applying a seaming coat of the coating material to the sling body and to at least one of the second sling body.

6. The method in accordance with claim 1, further comprising:

repairing damage to the coating on the sling body by applying a layer of the coating to the damaged area.

7. A method of manufacturing single and multi-core lifting slings, the method comprising:

aligning a plurality of core fibers to form a sling body;

tensioning the sling body to normal use load bearing conditions causing the plurality of core fibers to stretch;

applying a coating along length of the sling body while stretched, an initial layer of the coating seals the plurality of core fibers from exposure to contaminates, the coating comprising at least an isocyanate mixed with an amine forming polyurea;

applying additional layers of the coating in areas of the sling body subject to high crush and shear forces; and applying a final splatter layer of the coating applied along the sling body, the final splatter layer creating a rugged non-slip grip exterior surface;

wherein under no load conditions of the sling body the coating will be in maximum compression and during normal use load bearing conditions of the sling body the coating material will be under slight compression or slight tension.

8. The method in accordance with claim 7, further comprising:

positioning a safety core proximate the plurality of core fibers.

9. The method in accordance with claim 7, further comprising:

forming at least one of a second sling body from a second plurality of core fibers; and forming a multi-core lifting sling by applying a seaming coat of the coating material to the sling body and to at least one of the second sling body.

10. A method of manufacturing single and multi-core lifting slings, the method comprising:

forming a sling body and at least one of a second sling body from a plurality of core fibers;

applying a coating along length of the sling body and the second sling body, an initial layer of the coating seals the plurality of core fibers from exposure to contaminates, the coating comprising at least an isocyanate mixed with an amine forming polyurea;

applying additional layers of the coating in areas of the sling body subject to high crush and shear forces;

forming a multi-core lifting sling by applying a seaming coat of the coating material to the sling body and to at least one of the second sling body;

applying a final splatter layer of the coating applied along the sling body, the final splatter layer creating a rugged non-slip grip exterior surface.

11. The method in accordance with claim 10, further comprising:

positioning a safety core proximate the plurality of core fibers.

12. The method in accordance with claim 10, further comprising:

tensioning the sling body to normal use load bearing conditions causing the plurality of core fibers to stretch.

* * * * *